US008741519B2

(12) United States Patent
Watanabe et al.

(10) Patent No.: US 8,741,519 B2
(45) Date of Patent: Jun. 3, 2014

(54) TONER

(71) Applicant: Canon Kabushiki Kaisha, Tokyo (JP)

(72) Inventors: Shuntaro Watanabe, Hadano (JP); Kenji Aoki, Mishima (JP); Tetsuya Kinumatsu, Numazu (JP); Takaaki Kaya, Suntou-gun (JP); Atsushi Tani, Suntou-gun (JP); Ayako Okamoto, Wako (JP); Toshifumi Mori, Suntou-gun (JP); Yoshihiro Nakagawa, Numazu (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,359

(22) Filed: Jan. 14, 2013

(65) Prior Publication Data

US 2013/0130170 A1 May 23, 2013

Related U.S. Application Data

(63) Continuation of application No. PCT/JP2012/064333, filed on Jun. 1, 2012.

(30) Foreign Application Priority Data

Jun. 3, 2011 (JP) ..... 2011-125764

(51) Int. Cl.
*G03G 9/00* (2006.01)

(52) U.S. Cl.
USPC ..... 430/109.3; 430/109.1; 430/110.2; 430/137.1

(58) Field of Classification Search
USPC ..... 430/109.1, 109.3, 110.2, 137.1
See application file for complete search history.

(56) References Cited

U.S. PATENT DOCUMENTS 5,135,833 A 8/1992 Matsunaga et al.
5,298,354 A 3/1994 Matsunaga et al.

(Continued)

FOREIGN PATENT DOCUMENTS

JP 2006-337751 A 12/2006
JP 2007-277511 A 10/2007

(Continued)

OTHER PUBLICATIONS

Kaya, et al., U.S. Appl. No. 13/741,356, filed Jan. 14, 2013.

(Continued)

*Primary Examiner* — Thorl Chea
(74) *Attorney, Agent, or Firm* — Fitzpatrick, Cella, Harper and Scinto

(57) ABSTRACT

Provided is a toner having an excellent low-temperature fixability and hot offset resistance, a broad fixing temperature latitude in low-temperature areas to high-temperature areas, and a high heat-resistant storage stability. The toner includes toner particles having a core-shell structure in which a shell phase containing a resin A is formed on a core containing a binder resin, a colorant and a wax. In measurement of resin A by a differential scanning calorimetry (DSC), the peak temperature TpA (° C.) of a maximum endothermic peak in the first temperature rise is at least 55° C. but not more than 80° C. In measurement of a viscoelasticity of resin A, the loss elastic modulus at TpA−10 (° C.) is at least $1\times10^7$ Pa but not more than $1\times10^8$ Pa. In measurement of the viscoelasticity of resin A, the loss elastic moduli at TpA (° C.), TpA+10 (° C.) and TpA+25 (° C.) satisfy specific conditions.

9 Claims, 4 Drawing Sheets

(56) References Cited

U.S. PATENT DOCUMENTS

| | | | |
|---|---|---|---|
| 5,300,386 | A | 4/1994 | Kanbayashi et al. |
| 5,354,639 | A | 10/1994 | Kasuya et al. |
| 5,354,640 | A | 10/1994 | Kanbayashi et al. |
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,736,288 | A | 4/1998 | Kasuya et al. |
| 5,814,429 | A | 9/1998 | Kawakami et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,569,589 | B2 | 5/2003 | Inaba et al. |
| 6,586,151 | B1 | 7/2003 | Naka et al. |
| 6,664,016 | B2 | 12/2003 | Kanbayashi et al. |
| 6,703,176 | B2 | 3/2004 | Naka et al. |
| 6,751,424 | B2 | 6/2004 | Itakura et al. |
| 6,875,549 | B2 | 4/2005 | Yamazaki et al. |
| 6,881,527 | B2 | 4/2005 | Moribe et al. |
| 6,905,808 | B2 | 6/2005 | Itakura et al. |
| 7,001,703 | B2 | 2/2006 | Moribe et al. |
| 7,014,969 | B2 | 3/2006 | Yachi et al. |
| 7,097,951 | B2 | 8/2006 | Moribe et al. |
| 7,147,980 | B2 | 12/2006 | Itakura et al. |
| 7,150,953 | B2 | 12/2006 | Yamazaki et al. |
| 7,229,727 | B2 | 6/2007 | Itakura et al. |
| 7,238,387 | B2 | 7/2007 | Ogawa et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,361,441 | B2 | 4/2008 | Itakura et al. |
| 7,402,368 | B2 | 7/2008 | Ogawa et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,776,501 | B2 | 8/2010 | Tamura et al. |
| 7,794,908 | B2 | 9/2010 | Kaya et al. |
| 7,794,909 | B2 | 9/2010 | Kaya et al. |
| 7,811,734 | B2 | 10/2010 | Ogawa et al. |
| 7,935,771 | B2 | 5/2011 | Fukui et al. |
| 7,939,231 | B2 | 5/2011 | Ogawa et al. |
| 7,943,281 | B2 | 5/2011 | Kaya et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,372,573 | B2 | 2/2013 | Ayaki et al. |
| 8,383,312 | B2 | 2/2013 | Fujimoto et al. |
| 2005/0208414 | A1 | 9/2005 | Nakamura et al. |
| 2006/0275679 | A1 | 12/2006 | Ishiyama et al. |
| 2008/0124635 | A1* | 5/2008 | Nakamura et al. ..... 430/48 |
| 2008/0286675 | A1 | 11/2008 | Tani et al. |
| 2009/0305159 | A1 | 12/2009 | Zhou et al. |
| 2010/0055593 | A1 | 3/2010 | Zhou et al. |
| 2010/0062355 | A1 | 3/2010 | Kaya et al. |
| 2011/0039200 | A1 | 2/2011 | Kaya et al. |
| 2011/0045398 | A1 | 2/2011 | Sekikawa et al. |
| 2011/0065039 | A1 | 3/2011 | Ota et al. |
| 2011/0136054 | A1 | 6/2011 | Watanabe et al. |
| 2011/0244383 | A1 | 10/2011 | Yamamoto et al. |
| 2011/0300478 | A1 | 12/2011 | Sekikawa et al. |
| 2012/0045717 | A1 | 2/2012 | Hiroko et al. |
| 2012/0171607 | A1 | 7/2012 | Ayaki et al. |
| 2012/0231384 | A1 | 9/2012 | Aoki et al. |

FOREIGN PATENT DOCUMENTS

| | | | |
|---|---|---|---|
| JP | 2008-287088 | A | 11/2008 |
| JP | 4285289 | B2 | 6/2009 |
| JP | 2009-294655 | A | 12/2009 |
| JP | 2010-55094 | A | 3/2010 |
| JP | 2010-150535 | A | 7/2010 |
| JP | 2010-175933 | A | 8/2010 |
| JP | 2011-232738 | A | 11/2011 |
| WO | 2009/122687 | A1 | 10/2009 |
| WO | 2011/152008 | A1 | 12/2011 |

OTHER PUBLICATIONS

Kinumatsu, et al., U.S. Appl. No. 13/741,369, filed Jan. 14, 2013.

Aoki, et al., U.S. Appl. No. 13/741,372, filed Jan. 14, 2013.

Span, et al., "A New Equation of State for Carbon Dioxide Covering the Fluid Region from the Triple-Point Temperature to 1100 K at Pressures up to 800 MPa", Journal of Physical and Chemical Reference Data, vol. 25, No. 6, 1996, pp. 1509-1596.

International Search Report dated Aug. 7, 2012 in International Application No. PCT/JP2012/064333.

Polymer Data Handbook: Basic Edition, The Society of Polymer Science, Japan: Baifukan Co., Ltd., 1986, pp. 258 to 327.

English translation of International Preliminary Report on Patentability, International Application No. PCT/JP2012/064333, Mailing Date Dec. 19, 2013.

* cited by examiner

TONER

This application is a continuation of International Application No. PCT/JP2012/064333, filed Jun. 1, 2012, the contents of which are incorporated by reference herein.

BACKGROUND OF THE INVENTION

1. Field of the Invention

The present invention relates to a toner for use in an image-forming method which utilizes electrophotographic technology, electrostatic recording technology or toner jet recording technology. More specifically, the invention relates to a toner for use in an image-forming method in which a toner image is formed on an electrostatic latent image-bearing member, then is transferred onto a transfer material to form a toner image which is subsequently fixed under heat and pressure to obtain a fixed image.

2. Description of the Related Art

How to implement energy savings in the field of copiers and printers has become a major technical concern in recent years. One approach that has arisen is to dramatically reduce the amount of heat applied to the fixing apparatus in electrophotographic equipment. This has led in turn to an increased need in toners for "low-temperature fixability" which enables sufficient fixing of the toner to occur at a lower energy.

One method that is known to be effective for enabling fixing to occur at lower temperatures is to confer the binder resin with sharp melting properties that allow the resin to melt under a small temperature change. It is in this connection that toners which use crystalline polyester resins have been proposed. Crystalline polyesters, because they have the property—owing to the regular arrangement of the molecular chain—of not exhibiting a distinct glass transition and not readily softening up to the crystal melting point, are being investigated as a material which can be endowed with both heat-resistant storage stability and low-temperature fixability.

WO 2009/122687 discloses a toner obtained by a dissolution suspension method wherein a block polymer which uses a polyester resin, a polyurethane resin, a polyurea resin, a polyamide resin or a polyether resin in crystalline segments and non-crystalline segments is used as a binder resin.

This disclosure describes, for the block polymer, about control of the viscoelastic behavior at the endothermic peak temperature Ta from the block polymer in heat of fusion measurement using a differential scanning calorimetry (DSC) and in the temperature range around the melt onset temperature X in a Koka-type flow tester.

When a crystalline polyester is used in the binder resin, sharp melting properties can be imparted to the toner. However, owing to inadequate viscosity during melting of the toner, hot offset readily arises in the fixing step on the high temperature side.

In the case of toners having a core-shell structure, it is conceivable to introduce a crystalline structure into the shell material itself.

Japanese Patent Application Laid-open No. 2010-150535 introduces a large number of structures capable of forming crystallinity, such as long-chain alkyl groups and crystalline polyester units, into the shell material, thereby conferring the shell material with sharp melting properties, and attempts in this way to endow the toner with both low-temperature fixability and heat-resistant storage stability. However, it has been found that this approach makes it difficult to maintain the viscosity during melting of the toner, leading to an inadequate hot offset resistance.

As a result, in toners having a core-shell structure, it is necessary not only to confer sharp melting properties, but also to suppress a decline in the viscosity of the overall toner due to melting of the binder resin.

Japanese Patent Publication No. 4285289 discloses, in a toner, which is obtained by agglomeration method, containing crystalline structures in the core, the art of utilizing metallic ions within an agglomerating agent for inducing agglomeration of the fine particles in order to effect crosslinking between molecular chains of the resin, and thereby retaining the high-temperature side viscosity of the toner. In this way, the viscosity of the binder resin during melting of the toner is retained, enhancing the temperature region in which fixing is possible.

However, it has been found that, in this method, because the molecular chains are strongly bonded chemically by ionic crosslinking, the decrease in viscosity during melting of the toner is suppressed, making it difficult to enhance the fixing temperature region.

Hence, there exists a need to carry out technical improvements in such a way as to not only impart sharp melting properties to the shell material, but also suppress a decrease in the viscosity of the shell material during melting of the toner on the high-temperature side in the fixing step, and thus ensure a decrease in the viscoelasticity of the overall toner.

SUMMARY OF THE INVENTION

The invention provides a toner which has excellent low-temperature fixability and hot offset resistance, has a broad fixing temperature latitude in low-temperature areas to high-temperature areas, and has a high heat-resistant storage stability.

The toner of the invention comprises toner particles comprising a core-shell structure composed of a core and a shell phase formed on the core, the shell phase containing a resin A and the core containing a binder resin, a colorant and a wax, in which, (i) in measurement of the resin A by a differential scanning calorimetry (DSC), a peak temperature TpA (° C.) of a maximum endothermic peak in a first temperature rise is at least 55° C. but not more than 80° C., (ii) in measurement of a viscoelasticity of the resin A, a loss elastic modulus G"a (TpA−10) at a temperature TpA−10 (° C.) which is 10° C. lower than the TpA is at least $1\times10^7$ Pa but not more than $1\times10^8$ Pa, (iii) In measurement of the viscoelasticity of the resin A, when the loss elastic modulus at the TpA (° C.) be G"a (TpA) [Pa], the loss elastic modulus at a temperature TpA+10 (° C.) which is 10° C. higher than the TpA is G"a (TpA+10) [Pa], and the loss elastic modulus at a temperature TpA+25 (° C.) which is 25° C. higher than the TpA be G"a (TpA+25) [Pa], and in measurement of a viscoelasticity of the binder resin, when a loss elastic modulus at the TpA+10 (° C.) is G"b(TpA+10) [Pa] and the loss elastic modulus at the TpA+25 (° C.) is G"b(TpA+25) [Pa], G"a(TpA), G"a(TpA+10), G"a(TpA+25), G"b(TpA+10) and G"b(TpA+25) satisfy the conditions of the following formulas (1), (2), (3) and (4):

$$1.0\leq\{\log(G''a(TpA))-\log(G''a(TpA+10)\}\leq4.0 \quad (1);$$

$$0.1\leq\{\log(G''a(TpA+10))-\log(G''a(TpA+25)\}\leq0.9 \quad (2);$$

$$-1.5\leq\{\log(G''a(TpA+10))-\log(G''b(TpA+10)\}\leq1.0 \quad (3); \text{ and}$$

$$G''a(TpA+25)>G''b(TpA+25) \quad (4).$$

This invention makes it possible to provide a toner which has both sharp melting properties and also retains viscosity during melting of the toner, which has an excellent low-temperature fixability and excellent hot offset resistance better than in the prior art, which has a broad fixing temperature latitude at low-temperature areas to high-temperature areas, and which has a high heat-resistant storage stability.

Further features of the present invention will become apparent from the following description of exemplary embodiments (with reference to the attached drawings).

DESCRIPTION OF THE EMBODIMENTS

Figure 1:
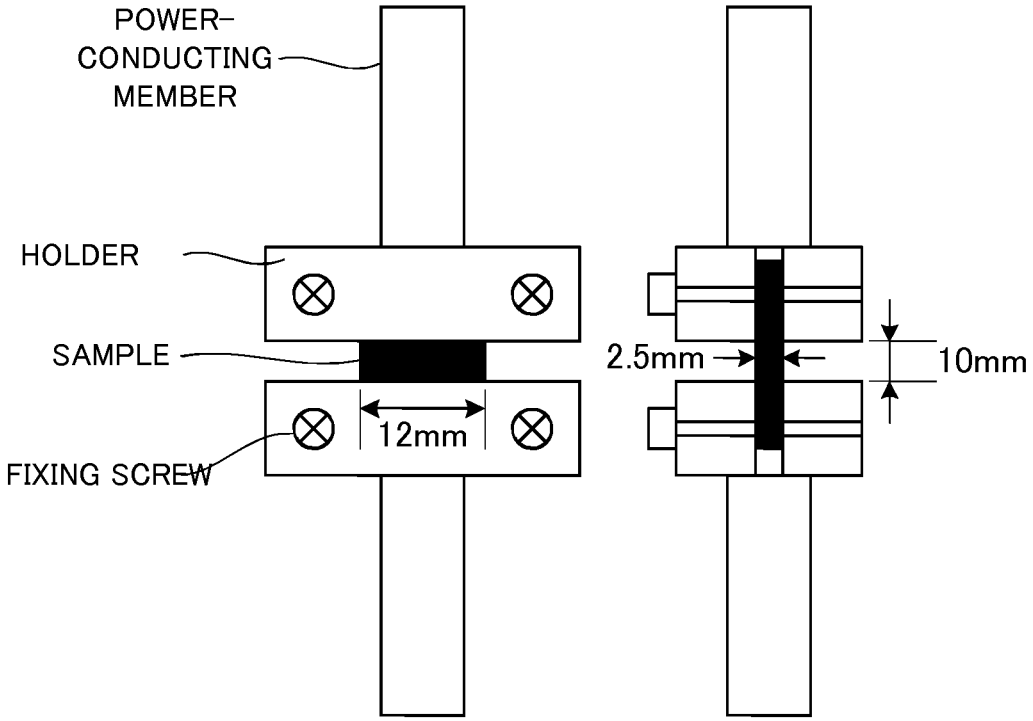
FIG. 1 is a schematic diagram showing a measurement sample and jig for measuring the viscoelasticity in the present invention.

The toner of the invention comprises toner particles comprising a core-shell structure composed of a core and a shell phase formed on the core, the shell phase containing a resin A, and the core containing a binder resin, a colorant and a wax. The shell phase may cover the core as a layer having a distinct interface, or may be in a form which covers the core in a state without a distinct interface.

<Resin A>

The resin A in the toner of the invention, in measurement by a differential scanning calorimetry (DSC), has a peak temperature TpA (° C.) for the maximum endothermic peak in a first temperature rise of at least 55° C. but not more than 80° C., and preferably at least 55° C. but not more than 75° C. At TpA below 55° C., the heat-resistant storage stability decreases, as a result of which agglomeration of the toner tends to occur due to the rise in temperature within a printer during operation. At TpA above 80° C., control of the toner viscoelasticity is difficult, making it impossible to design a toner having sharp melting properties in the fixing temperature region, as a result of which the low-temperature fixability decreases.

No limitation is imposed on the resin used as resin A although, by suitably changing the types of monomers serving as the starting materials which are used to synthesize resin A, it is possible to adjust TpA within the above range.

The toner of the invention, in measurement of the viscoelasticity of resin A, has a loss elastic modulus G"a (TpA−10) [Pa] at a temperature TpA−10 (° C.) that is 10° C. lower than TpA which is at least $1\times10^7$ Pa but not more than $1\times10^8$ Pa, and preferably at least $2.0\times10^7$ Pa but not more than $1\times10^8$ Pa. If G"a(TpA−10) [Pa] is less than $1\times10^7$ Pa, the viscosity of the toner surface layer becomes too low, resulting in a decrease in the heat-resistant storage stability. On the other hand, if G"a(TpA−10) [Pa] is more than $1\times10^8$ Pa, the viscosity before melting of the toner is too high, resulting in a decline in the low-temperature fixability.

No limitation is imposed on the resin used as resin A although, by suitably changing the types of monomers serving as the starting materials which are used to synthesize resin A or by suitably changing the composition and degree of polymerization of resin A, it is possible to adjust G"a(TpA−10) within the above range.

The toner of the invention, in measurement of the viscoelasticity of resin A, letting the loss elastic modulus at TpA (° C.) be G"a (TpA) [Pa] and the loss elastic modulus at a temperature TpA+10 (° C.) which is 10° C. higher than TpA be G"a (TpA+10) [Pa], satisfies the following formula (1):

$$1.0\leq\{\log(G''a(TpA))-\log(G''a(TpA+10))\}\leq4.0 \quad (1).$$

Preferably, $1.5\{\log(G''a(TpA))-\log(G''a(TpA+10))\}\leq3.0$.

In formula (1), $\{\log(G''a(TpA))-\log(G''a(TpA+10))\}$ expresses the amount of change in viscoelasticity near the melting point of resin A. By having the change in the viscoelasticity of resin A satisfy formula (1), the shell phase is ensured of being sufficiently sharp melting, making it possible to maximize the sharp melting properties in the binder resin of the toner.

In this invention, "log" refers to the common (base ten) logarithm.

In cases where the value of $\{\log(G''a(TpA))-\log(G''a(TpA+10))\}$ is below 1.0, the shell phase does not melt sufficiently, hindering extraction of the binder resin, and thus lowering the low-temperature fixability. On the other hand, if this value exceeds 4.0, the shell material sufficiently melts, but the toner undergoes a marked decrease in viscosity, lowering the hot offset resistance.

Low-temperature fixability becomes possible by satisfying formula (1), although if the toner melts more than necessary, maintaining the high-temperature side viscosity becomes difficult.

In measurement of the viscoelasticity of resin A, letting the loss elastic modulus at TpA+10 (° C.) which is 10° C. higher than TpA be G"a (TpA+10) [Pa] and the loss elastic modulus at a temperature TpA+25 (° C.) which is 25° C. higher than TpA be G"a (TpA+25) [Pa], the toner of the invention satisfies the following formula (2):

$$0.1\leq\{\log(G''a(TpA+10))-\log(G''a(TpA+25))\}\leq0.9 \quad (2).$$

Preferably, $0.2\leq\{\log(G''a(TpA+10))-\log(G''a(TpA+25))\}\leq0.8$.

In formula (2), $\{\log(G''a(TpA+10))-\log(G''a(TpA+25))\}$ expresses the amount of change in viscoelasticity of resin A from TpA+10 (° C.) to TpA+25 (° C.). By setting the amount of change as shown in formula (2), it is possible to suppress a decline in viscosity when the shell phase is molten.

In cases where the value of $\{\log(G''a(TpA+10))-\log(G''a(TpA+25))\}$ is below 0.1, excessive viscosity is retained, as a result of which the fixing temperature on the high-temperature side decreases. On the other hand, if this value exceeds 0.9, the toner viscosity dramatically decreases, lowering the hot offset resistance. The desired effect is difficult to achieve in a toner that does not maintain a core-shell structure.

The toner composition and method of manufacture for satisfying the conditions of the invention are described below, although the invention is not necessarily limited to this toner composition and method of manufacture.

In the invention, Resin A is preferably a resin obtained by copolymerizing a vinyl monomer-a which contains in the molecular structure a segment capable of forming a crystalline structure with a vinyl monomer-b which is free from a segment capable of forming a crystalline structure in the molecular structure. As used herein, the "segment capable of forming a crystalline structure" is a segment which, on gathering together in large numbers, forms a regular arrangement and exhibits crystallinity, and refers specifically to a crystalline polymer chain.

<Vinyl Monomer-a>

The composition of vinyl monomer-a is not particularly limited. Examples include vinyl monomers containing in the molecular structure a linear alkyl group as the segment capable of forming a crystalline structure, and vinyl monomers containing a polyester component in the molecular structure.

Of these, vinyl monomers containing a polyester component in the molecular structure are preferred. The polyester component serving as the segment capable of forming a crystalline structure is a crystalline polyester component. Alternatively, vinyl monomers containing a linear alkyl group in the molecular structure and vinyl monomers containing a polyester component in the molecular structure may be used in admixture as vinyl monomer-a.

The polyester component is preferably a crystalline polyester component obtained by reacting an aliphatic diol having at least 4 but not more than 20 carbons with a polycarboxylic acid. Moreover, the aliphatic diol is preferably a linear aliphatic diol which readily increases the crystallinity.

The linear aliphatic diol is exemplified by, but not limited to, the following (which may also be used in admixture): 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecandiol, 1,18-octadecanediol, and 1,20-eicosanediol.

Of these, from the standpoint of having a melting point suitable for low-temperature fixability, 1,4-butanediol, 1,5-pentanediol and 1,6-hexanediol are preferred.

Next, aromatic dicarboxylic acids and aliphatic dicarboxylic acids are preferred as the polycarboxylic acid. Of these, aliphatic dicarboxylic acids are more preferred, and linear aliphatic dicarboxylic acids are especially preferred from the standpoint of forming a crystalline structure.

Examples of aliphatic dicarboxylic acids include, but are not limited to, the following (which may also be used in admixture): oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, as well as lower alkyl esters and acid anhydrides thereof. Of these, sebacic acid, adipic acid, 1,10-decanedicarboxylic acid, and lower alkyl esters or acid anhydrides thereof are preferred.

Examples of aromatic dicarboxylic acids include terephthalic acid, isophthalic acid, 2,6-naphthalenedicarboxylic acid and 4,4'-biphenyldicarboxylic acid.

Of these, in the invention, linear aliphatic dicarboxylic acids which are preferred from the standpoint of melting points suitable for low-temperature fixability are adipic acid, sebacic acid, 1,12-dodecanedicarboxylic acid and 1,16-hexadecanedicarboxylic acid.

No particular limitation is imposed on the method of preparing the above crystalline polyester. Preparation may be carried out by an ordinary polyester polymerization process in which an acid component is reacted with an alcohol component. Preparation may be carried out by the selective use of, for example, direct polycondensation or transesterification, depending on the types of monomers used.

Preparation of the crystalline polyester is preferably carried out at a polymerization temperature of at least 180° C. but not more than 230° C. Optionally, it may be preferable to place the reaction system under a reduced pressure and to carry out the reaction while removing water and alcohol generated during condensation. In cases where the monomer does not dissolve or is not compatible at the reaction temperature, it is preferable to induce dissolution by adding a high-boiling solvent as a solubilizing agent. In a polycondensation reaction, the reaction is carried out while distilling off the solubilizing agent. In cases where a monomer having poor compatibility is present in a copolymerization reaction, it is preferable to first condense the monomer having a poor solubility with the acid or alcohol that is to be polycondensed with the monomer, then to effect polycondensation together with the main component.

Illustrative examples of catalysts that may be used in preparing the crystalline polyester include titanium catalysts such as titanium tetraethoxide, titanium tetrapropoxide, titanium tetraisopropoxide and titanium tetrabutoxide; and tin catalysts such as dibutyltin dichloride, dibutyltin oxide and diphenyltin oxide.

The method of preparing a vinyl monomer containing in the molecular structure a crystalline polyester component as the segment capable of forming a crystalline structure is exemplified by a method that involves subjecting the crystalline polyester component and the hydroxyl group-containing vinyl monomer to a urethane-forming reaction together with diisocyanate as the binder.

At this time, it is preferable for the crystalline polyester component to be alcohol-terminated. To this end, in preparation of the crystalline polyester, it is preferable for the molar ratio of the acid component to the alcohol component (alcohol component/carboxylic acid component) to be at least 1.02 and not more than 1.20.

Illustrative examples of the hydroxyl group-containing vinyl monomer include hydroxystyrene, N-methylol acrylamide, N-methylol methacrylamide, hydroxyethyl acrylate, hydroxyethyl methacrylate, hydroxypropyl acrylate, hydroxypropyl methacrylate, polyethylene glycol acrylate, polyethylene glycol monomethacrylate, allyl alcohol, methallyl alcohol, crotyl alcohol, isocrotyl alcohol, 1-buten-3-ol, 2-buten-1-ol, 2-buten-1,4-diol, propargyl alcohol, 2-hydroxyethylpropenyl ether and sucrose allyl ether. Of these, hydroxy ethyl methacrylate is preferred.

Examples of the diisocyanate include aromatic diisocyanates having at least 6 but not more than 20 carbons (excluding the carbon on the NCO group; the same applies below), aliphatic diisocyanates having at least 2 but not more than 18 carbons, alicyclic diisocyanates having at least 4 but not more than 15 carbons, modified forms of such diisocyanates (modified forms containing a urethane group, a carbodiimide group, an allophanate group, a urea group, a biuret group, a uretdione group, a uretimine group, an isocyanurate group or an oxazolidone group; these are also referred to below as "modified diisocyanates"), and mixtures of two or more thereof.

Examples of aliphatic diisocyanates include ethylene diisocyanate, tetramethylene diisocyanate, hexamethylene diisocyanate (HDI) and dodecamethylene diisocyanate.

Examples of alicyclic diisocyanates include isophorone diisocyanate (IPDI), dicyclohexylmethane 4,4'-diisocyanate, cyclohexylene diisocyanate and methylcyclohexylene diisocyanate.

Examples of aromatic diisocyanates include m- and/or p-xylylene diisocyanate (XDI) and $\alpha,\alpha,\alpha',\alpha'$-tetramethylxylylene diisocyanate.

Preferred examples of these include aromatic diisocyanates having at least 6 but not more than 15 carbons, aliphatic diisocyanates having at least 4 but not more than 12 carbons, and alicyclic diisocyanates having at least 4 but not more than 15 carbons. HDI, IPDI and XDI are especially preferred.

In addition to the above diisocyanates, isocyanate compounds having a functionality of three or more may also be used.

The crystalline polyester component preferably has a maximum endothermic peak temperature in DSC measurement of at least 55° C. but not more than 80° C. Within this temperature range, it is possible to set the TpA of Resin A in the above-described range.

The crystalline polyester component has, in GPC measurement of the tetrahydrofuran (THF)-soluble matter, a number-average molecular weight (Mn) of preferably at least 1,000 and not more than 20,000, and a weight-average molecular weight (Mw) of preferably at least 2,000 and not more than 40,000. Within this range, a good heat-resistant storage stability can be retained, making it possible to impart even sharper melting properties to the toner. The Mn is more preferably in the range of at least 2,000 and not more than 15,000, and the Mw is more preferably in the range of at least 3,000 and not more than 20,000. The ratio Mw/Mn is preferably 5 or less, and more preferably 3 or less.

The vinyl monomer containing the above linear alkyl group in the molecular structure is preferably an alkyl acrylate or alkyl methacrylate having 12 or more carbons on the alkyl group. Illustrative examples include lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate and behenyl methacrylate.

Resin A is preferably a resin obtained by copolymerizing at least 20.0 mass % but not more than 50.0 mass % of vinyl monomer-a and at least 50.0 mass % but not more than 80.0 mass % of vinyl monomer b, based on the total amount of polymerizable monomers which form resin A.

At a vinyl monomer-a content in Resin A of 20.0 mass % or more, it is possible to satisfy the condition set forth in formula (1), which expresses the change in the loss elastic modulus of the resin A from the temperature TpA (° C.) to the temperature TpA+10 (° C.).

At a vinyl monomer-a content in Resin A of 50.0 mass % or less, a suitably amount of the segments capable of forming a crystalline structure is present, further improving the charging performance, in addition to which the loss elastic modulus of Resin A is able to satisfy the condition set forth in formula (2).

<Vinyl Monomer-b>

In the invention, the vinyl monomer-b used to synthesize Resin A may be composed of a single vinyl monomer or of two or more different vinyl monomers.

The vinyl monomer-b used in the invention preferably includes a vinyl monomer having in a homopolymer thereof a glass transition temperature (Tg (° C.)) (which vinyl monomer is also referred to below as a "high Tg vinyl monomer").

Illustrative examples of high Tg vinyl monomers include dimethyl acrylamide (Tg=114° C.), acrylamide (Tg=191° C.), monomethyl acrylamide (Tg=171° C.), tert-butyl methacrylate (Tg=107° C.), vinylbenzoic acid (Tg=177° C.), 2-methylstyrene (Tg=127° C.), acrylic acid (Tg=111° C.), methacrylic acid (Tg=170° C.), methyl methacrylate (Tg=107° C.) and 4-hydroxysytrene (Tg=156° C.). Of these, 2-methylstyrene (Tg=127° C.), methacrylic acid (Tg=170° C.), methyl methacrylate (Tg=107° C.) and acrylic acid (Tg=111° C.) are especially preferred.

The above glass transition temperatures Tg in a homopolymer are median values of measurements on homopolymers alone (neat resin) obtained from the National Institute for Materials Science (NIMS) polymer database (polyinfo).

The content of the high Tg vinyl monomer, based on the total monomer used in copolymerization of Resin A, is preferably at least 1.0 mass % but not more than 15.0 mass %, and more preferably at least 2.0 mass % but not more than 10.0 mass %. When the amount of high Tg vinyl monomer added is at least 1.0 mass %, Resin A easily satisfies formula (2). When the amount of high Tg vinyl monomer added is not more than 15.0 mass %, the resin viscosity has a suitable viscosity, as a result of which formula (1) is easily satisfied in Resin A.

In addition, the following monomers may be used together with the above high Tg vinyl monomers as vinyl monomer-b in this invention. Specific examples are given below.

Aliphatic vinyl hydrocarbons: alkenes (ethylene, propylene, butene, isobutylene, pentene, heptene, diisobutylene, octene, dodecene, octadecene, α-olefins other than the above); and alkadienes (butadiene, isoprene, 1,4-pentadiene, 1,6-hexadiene and 1,7-octadiene).

Alicyclic vinyl hydrocarbons: mono- or dicycloalkenes and alkadienes (cyclohexane, cyclopentadiene, vinylcyclohexene, ethylidenebicycloheptene); and terpenes (pinene, limonene, indene).

Aromatic vinyl hydrocarbons: styrene and hydrocarbyl (alkyl, cycloalkyl, aralkyl and/or alkenyl)-substituted styrenes (α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene); and vinylnapthalene.

Carboxyl group-containing vinyl monomers and metal salts thereof: unsaturated monocarboxylic acids of at least 3 but not more than 30 carbons, unsaturated dicarboxylic acids and anhydrides and monoalkyl (of at least 1 but not more than 11 carbon) esters thereof (maleic acid, maleic anhydride, monoalkyl esters of maleic acid, fumaric acid, monoalkyl esters of fumaric acid, crotonic acid, itaconic acid, monoalkyl esters of itaconic acid, glycol monoethers of itaconic acid, citraconic acid, monoalkyl esters of citraconic acid, and carboxyl group-containing vinyl monomers of cinnamic acid).

Vinyl esters (vinyl acetate, vinyl butyrate, vinyl propionate, vinyl butyrate, diallyl phthalate, diallyl adipate, isopropenyl acetate, vinyl methacrylate, methyl 4-vinylbenzoate, cyclohexyl methacrylate, benzyl methacrylate, phenyl acrylate, phenyl methacrylate, vinyl methoxy acetate, vinyl benzoate, ethyl α-ethoxyacrylate), alkyl acrylates and alkyl methacrylates having an alkyl group (linear or branched) of at least 1 but not more than 11 carbons (methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, dialkyl fumarates (dialkyl esters of fumaric acid, the two alkyl groups being linear, branched or alicyclic groups of at least 2 but not more than 8 carbons), and dialkyl maleates (dialkyl esters of maleic acid, the two alkyl groups being linear, branched or alicyclic groups of at least 2 but not more than 8 carbons)), polyallyloxy alkanes (diallyloxyethane, triallyloxyethane, tetrallyloxyethane, tetraallyloxypropane, tetraallyloxybutane, tetramethallyloxyethane), vinyl monomers having polyalkylene glycol chains (polyethylene glycol (molecular weight 300) monoacrylate, polyethylene glycol (molecular weight 300) monomethacrylate, polypropylene glycol (molecular weight 500) monoacrylate, polypropylene glycol (molecular weight, 500) monomethacrylate, methyl alcohol 10 mole ethylene oxide (ethylene oxide is abbreviated below as "EO") adduct acrylate, methyl alcohol 10 mole EO adduct methacrylate, lauryl alcohol 30 mole EO adduct acrylate, lauryl alcohol 30 mole EO adduct methacrylate), and polyacrylates and polymethacrylates (polyacrylates and polymethacrylates of polyols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, polyethylene glycol dimethacrylate).

In addition, vinyl monomers having the organic polysiloxane structure shown in Chemical Formula 1 below may be used together with the above as vinyl monomer b. Use of such a vinyl monomer having an organic polysiloxane structure is preferable in the subsequently described method of manufacturing toner particles using carbon dioxide in a high-pressure state as the dispersion medium.

[C1]

Chemical Formula 1

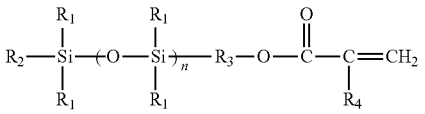

Here, $R_1$ and $R_2$ are each independently an alkyl group, each preferably having at least 1 but not more than 3 carbons, with the number of carbons on $R_1$ being more preferably 1. $R_3$ is preferably an alkylene group, and more preferably an alkylene group having at least 1 but not more than 3 carbons. $R_4$ is hydrogen or a methyl group. The letter n represents the degree of polymerization, which degree of polymerization n is an integer of preferably at least 2 but not more than 100, more preferably at least 2 but not more than 18, and even more preferably at least 2 but not more than 15.

In the invention, Resin A is preferably a vinyl resin obtained by polymerization wherein, of the 100.0 mass % of the total monomers used in the copolymerization of Resin A, at least 5.0 mass % but not more than 20.0 mass % is a vinyl monomer having the organic polysiloxane structure shown in Chemical Formula 1. By obtaining Resin A in this proportion, a suitable amount of the organic polysiloxane structure is readily achieved in Resin A, thereby facilitating, in a production method that uses carbon dioxide in a liquid or supercritical state as the dispersion medium, the stable dispersion of Resin A within the dispersion medium in a resin fine particle state.

In gel permeation chromatography (GPC) of the tetrahydrofuran (THF)-soluble matter of Resin A which forms the shell phase in the invention, the number-average molecular weight (Mn) is preferably at least 8,000 but not more than 40,000, and the weight-average molecular weight (Mw) is preferably at least 15,000 but not more than 90,000. Within this range, the heat-resistant storage stability can be well retained, in addition to which sharp melting properties can be conferred. The Mn is more preferably in the range of at least 8,000 but not more than 25,000, and the Mw is more preferably in the range of at least 20,000 but not more than 80,000. In addition, the ratio Mw/Mn is preferably 7 or less.

In cases where the toner particles are produced by the subsequently described method, it is preferable for the resin which forms the shell phase in the invention to not dissolve in the dispersion medium. Accordingly, a crosslinked structure may be introduced to the resin. Also, the proportion of Resin A in the resin which forms the shell phase in the invention, although not particularly limited, is preferably 50.0 mass % or more. It is especially preferable to not use a resin other than Resin A as the shell phase.

<Binder Resin>

The toner of the invention, in measurement of the viscoelasticity of the binder resin used in the toner, when the loss elastic modulus at TpA+10 (° C.) is G"b(TpA+10) [Pa], satisfies formula (3) below:

$$-1.5 \leq \{\log(G''a(TpA+10)) - \log(G''b(TpA+10)\} \leq 1.0 \quad (3).$$

Preferably, $-1.3 \leq \{\log(G''a(TpA+10)) - \log(G''b\ (TpA+10))\} \leq 0.8$.

In formula (3), {log(G"a(TpA+10))−log(G"b(TpA+10))} expresses the difference in the viscoelasticities of the binder resin and Resin A at the temperature at which Resin A melts.

Within the range of formula (3), the difference in the viscosities of the binder resin which serves as the core material and Resin A during melting does not become excessively large. By satisfying this condition, the fixability is stabilized because the shell phase does not hinder extraction of the binder resin during fixing.

In cases where the value of {log(G"a(TpA+10))−log(G"b (TpA+10))} is smaller than −1.5, the decrease in the viscoelasticity of Resin A becomes pronounced compared with the binder resin, making it difficult to maintain the viscosity of the overall toner during toner melting. On the other hand, when this value exceeds 1.0, the viscosity of Resin A during toner melting become too much higher than the viscosity of the binder resin, resulting in a decrease in fixability.

The value of {log(G"a(TpA+10))−log(G"b(TpA+10))} may be adjusted within the above range by suitably varying the combinations of starting materials which make up, respectively, the binder resin and Resin A, and the degrees of polymerization of the respective resins.

In measurement of the viscoelasticity of the binder resin used in the toner of the invention, when the loss elastic modulus at TpA+25 (° C.) is G"b(TpA+25) [Pa], the toner satisfies the conditions of formula (4) below:

$$G''a(TpA+25) > G''b(TpA+25) \quad (4).$$

Formula (4) expresses the relative magnitudes of the viscosities of the binder resin and Resin A at a temperature at which Resin A has fully melted. By using a Resin A and a binder resin which satisfy formula (4), it is possible to produce toner particles in which the viscosity of the shell material is maintained at a suitable level even when the binder resin has melted. In cases where the condition of formula (4) is not satisfied, the decline in the viscosity of Resin A ends up being larger than the decline in the viscosity of the binder resin. Because this makes it difficult for extraction of the binder resin to occur even in a high-temperature region, and also for melting of the toner as a whole to arise, the fixability decreases.

The value G"b(TpA+25) [Pa] is preferably at least $1.0\times10^3$ Pa, but not more than $1.0\times10^5$ Pa, and more preferably at least $5.0\times10^3$ Pa, but not more than $8.0\times10^4$ Pa. By setting G"b (TpA+25) [Pa] in this range, formula (4) is easily satisfied, making it possible to fully ensure the sharp melting properties of the toner particle core, and also making it possible to maintain the high temperature-side viscoelasticity of the toner.

In the toner of the invention, it is possible to use either a crystalline resin or a non-crystalline resin in the binder resin. Alternatively, these may be used in admixture. Of these, it is preferable for the binder resin to include a crystalline resin. Here, the term "crystalline resin" refers to a resin having a crystalline structure in which the molecular chains of the polymer are regularly arranged. Accordingly, substantially no softening of the resin occurs up to a temperature close to the melting point; when the temperature approaches the melting point, melting arises and the resin suddenly softens. In the invention, a crystalline polyester is preferably used as the crystalline resin.

Also, in the toner of the invention, the fact that the content of the above crystalline resin in the binder resin is at least 50 mass % but not more than 85 mass % makes it possible to further enhance the low-temperature fixability and the heat-resistant storage stability. The binder resin of the invention, in measurement by a differential scanning calorimetry (DSC), has a peak temperature for the maximum endothermic peak in a first temperature rise which is preferably at least 55° C. but not more than 80° C. Within this range, the relationship between the viscosities of Resin A and the binder resin easily satisfy formulas (3) and (4).

In cases where a crystalline polyester is used as the crystalline resin, it is preferable to use in the synthesis thereof a monomer capable of being used in the synthesis of the crystalline polyester component which may be used in Resin A. The aliphatic diol used at this time may be an aliphatic diol having a double bond, examples of which include 2-butene-1,4-diol, 3-hexen-1,6-diol and 4-octen-1,8-diol.

In addition, the polycarboxylic acid used may be a dicarboxylic acid having a double bond. Examples of such dicarboxylic acids include, but are not limited to, fumaric acid, maleic acid, 3-hexenedioc acid and 3-octenedioc acid, and also lower alkyl esters and acid anhydrides thereof. Of these, fumaric acid and maleic acid are preferred from the standpoint of cost.

Next, the non-crystalline resin which may be used in the binder resin of the invention is described.

Examples of non-crystalline resins which may be used in the binder resin include, but are not limited to, polyurethane resins, polyester resins, styrene-acrylic acid resins and vinyl resins such as polystyrene. These resins may be subjected to urethane, urea or epoxy modification. Of these, from the standpoint of maintaining the viscosity, the use of a polyester resin or a polyurethane resin is preferred.

Examples of the monomer used in the polyester resin serving as the above non-crystalline resin include the carboxylic acids having a functionality of two, three or more and the alcohols having a functionality of two, three or more which are mentioned in *Polymer Data Handbook, Basic Edition* (edited by The Society of Polymer Science, Japan; published by Baifukan). Specific examples of these monomer components include the following compounds. Examples of dicarboxylic acids include dibasic acids such as succinic acid, adipic acid, sebacic acid, phthalic acid, isophthalic acid, terephthalic acid, malonic acid and dodecenylsuccinic acid, as well as anhydrides and lower alkyl esters thereof; and aliphatic unsaturated dicarboxylic acids such as maleic acid, fumaric acid, itaconic acid and citraconic acid. Examples of tri- or higher carboxylic acids include 1,2,4-benzenetricarboxylic acid, and anhydrides and lower alkyl esters thereof. These may be used singly or two or more may be used in combination.

Examples of dihydric alcohols include the following compounds: bisphenol A, hydrogenated bisphenol A, ethylene oxide adducts of bisphenol A, propylene oxide adducts of bisphenol A, 1,4-cyclohexanediol, 1,4-cyclohexanedimethanol, ethylene glycol and propylene glycol. Examples of trihydric or higher alcohols include the following compounds: glycerol, trimethylolethane, trimethylolpropane and pentaerythritol. These may be used singly, or two or more may be used in combination. To adjust the acid value or hydroxyl value, optional use may be made of a monoacid such as acetic acid or benzoic acid or a monohydric alcohol such as cyclohexanol or benzyl alcohol.

The polyester resin may be synthesized by a known method using the above monomer components.

Next, polyurethane resins which may be used as the above non-crystalline resin are described. Polyurethane resins are a reaction product of an aliphatic diol with a diisocyanate. By changing the aliphatic diol and the diisocyanate, the functionality of the resulting resin can be changed.

Examples of the diisocyanate includes diisocyanates which may be used in Resin A. Aliphatic diols which may be used in the polyurethane resin include the following.

Alkylene glycols (ethylene glycol, 1,2-propylene glycol, 1,3-propylene glycol); alkylene ether glycols (polyethylene glycol, polypropylene glycol); alicyclic diols (1,4-cyclohexanedimethanol); bisphenols (bisphenol A); and alkylene oxide adducts of alicyclic diols (ethylene oxide, propylene oxide). The alkyl moieties of these alkylene ether glycols may be linear or branched. In the invention, preferred use may also be made of alkylene glycols having a branched structure.

In the invention, by including the above non-crystalline resin within the binder resin in a range that does not influence the low-temperature fixability, it is possible to maintain the viscosity after sharp melting of the crystalline resin.

The glass transition temperature (Tg) of the non-crystalline resin in the binder resin is preferably at least 50° C. but not more than 130° C., and more preferably at least 70° C. and not more than 130° C. In this range, the elasticity in the fixing region is easily maintained.

Moreover, in a preferred aspect, the toner of the invention uses a block polymer in which segments capable of forming a crystalline structure and segments incapable of forming a crystalline structure are chemically bonded is used as a main component of the binder resin. In the invention, the phrase "a main component of the binder resin" signifies a block polymer content of at least 50 parts by mass per 100 parts by mass of the binder resin.

The block polymer is a polymer having different polymers covalently bonded to each other within a single molecule. Here, the "segment capable of forming a crystalline structure" is a crystalline polyester, and the "segment incapable of forming a crystalline structure" is a polyester or polyurethane which is a non-crystalline resin.

In the invention, the block polymer may be used in any of the following forms wherein a crystalline polymer chain is designated as "A" and a non-crystalline polymer chain is designated as "B": AB-type diblock polymers, ABA-type triblock polymers, BAB-type triblock polymers, and ABAB . . . -type multiblock polymers.

In the block polymer, the form of the bonds that link together via covalent bonds the segments capable of forming a crystalline structure and the segments incapable of forming a crystalline structure include ester bonds, urea bonds and urethane bonds. Of these, a block polymer in which these segments are bonded together with urethane bonds is more preferred. By having the block polymer be one in which the segments are bonded together with urethane bonds, the viscosity is easily maintained. Moreover, in the invention, the content of the segments capable of forming a crystalline structure in the binder resin is preferably 50 mass % or more of the overall mass of the binder resin.

The method used to prepare the block polymer may be a two-step method in which the component which forms the segments capable of forming a crystalline structure and the component which forms the segments incapable of forming a crystalline structure are separately prepared, following which the two components are bonded together. Alternatively, a one-step method may be used in which the starting materials for the component which forms the segments capable of forming a crystalline structure and the starting materials for the component which forms the segments incapable of forming a crystalline structure are charged at the same time and prepared in a single operation.

The block polymer used in the invention may be synthesized by a method selected from among various methods while taking into account the reactivities of the respective terminal functional groups.

In the case of block polymers in which both the segments capable of forming a crystalline structure and the segments incapable of forming a crystalline structure are polyester resins, preparation may be carried out by separately preparing the respective components, then using a binder to bond together the segments. Particularly in those cases where one of the polyesters has a high acid value and the other polyester has a high hydroxyl value, a condensation reaction is able to proceed under the application of heat and pressure without requiring the use of a binder. The reaction in such a case is preferably carried out at a reaction temperature close to 200° C.

In cases where a binder is used, the binder is exemplified by polycarboxylic acids, polyols, polyisocyanates, polyfunctional epoxy compounds and polyacid anhydrides. Using these binders, synthesis may be carried out by a dehydration reaction or an addition reaction.

In the case of block polymers in which the segments capable of forming a crystalline structure are crystalline polyester and the segments incapable of forming a crystalline structure are polyurethane, after the respective segments have been separately prepared, the block polymer can be prepared by effecting a urethane-forming reaction between the alcohol ends of the crystalline polyester and the isocyanate ends of the polyurethane. Alternatively, synthesis may be carried out by mixing together a crystalline polyester having alcohol ends with the diol and the diisocyanate which will make up the polyurethane, and heating the mixture. In this case, at the initial stage of the reaction in which the diol and diisocyanate concentrations are high, these selectively react to form polyurethane. Once the molecular weight has become large to some degree, urethane formation arises between the isocyanate ends of the polyurethane and the alcohol ends of the crystalline polyester.

The block polymer has a number-average molecular weight of preferably at least 3,000 but not more than 40,000, and more preferably at least 7,000 but not more than 25,000. The block polymer has a weight-average molecular weight of preferably at least 10,000 but not more than 60,000, and more preferably at least 20,000 but not more than 50,000. Within this range, a good heat-resistant storage stability can be maintained, in addition to which the sharp melting properties of the toner can be further improved.

In the practice of the invention, the acid value of the block polymer is preferably at least 3.0 mgKOH/g but not more than 30.0 mgKOH/g, and more preferably at least 5.0 mgKOH/g but not more than 20.0 mgKOH/g. By setting the acid value in this range, the presence of liquid drops during granulation is stabilized during production of the toner particles in the subsequently described aqueous medium, enabling a more uniform particle size distribution to be obtained.

In the practice of the invention, the acid value of the block polymer can be adjusted by modifying the terminal isocyanate groups, hydroxyl groups and carboxyl groups on the block polymer with polycarboxylic acids, polyols, polyisocyanates, polyfunctional epoxy compounds, polyacid anhydrides or polyamines.

<Charge Control Agent>

In the toner of the invention, a charge control agent may be optionally mixed and used with the toner particles. Alternatively, a charge control agent may be added at the time of toner particle production. Including a charge control agent stabilizes the charge properties, enabling optimal triboelectric charge quantity control for the development system.

Use may be made of a known charge control agent, with a charge control agent having a rapid charging speed and capable of stably maintaining a constant charge quantity being preferred.

Examples of charge control agents which control the toner to a negative charge include the following: organic metal compounds and chelate compounds are effective, in addition to which there are also monoazo metal compounds, acetylacetone metal compounds, aromatic oxycarboxylic acids, aromatic dicarboxylic acids, and oxycarboxylic acid and dicarboxylic acid-based metal compounds. The toner of the invention may include such charge control agents either alone or as a combination of two or more thereof.

The amount of the charge control agent included per 100 parts by mass of the binder resin is preferably at least 0.01 parts by mass but not more than 20 parts by mass, and more preferably at least 0.5 parts by mass but not more than 10 parts by mass.

<Wax>

The toner particles used in the toner of the invention contain a wax. Examples of the wax include, but are not particularly limited to, the following.

Aliphatic hydrocarbon waxes such as low-molecular-weight polyethylene, low-molecular-weight polypropylene, low-molecular-weight olefin copolymers, microcrystalline waxes, paraffin waxes and Fischer-Tropsch waxes; oxides of aliphatic hydrocarbon waxes, such as polyethylene oxide waxes; waxes composed primarily of fatty acid esters, such as aliphatic hydrocarbon ester waxes; partially or completed deoxidized fatty acid esters, such as deoxidized carnauba wax; partially esterified products of fatty acids and polyols, such as behenic acid monoglyceride; and hydroxyl group-containing methyl ester compounds obtained by the hydrogenation of vegetable fats and oils.

From the standpoint of, in the dissolution suspension method, the ease of preparing a wax dispersion, the ease of take up into the toner produced, and also the bleedout properties from the toner and the toner releasability at the time of fixing, the waxes which are especially preferred for use in the invention are aliphatic hydrocarbon waxes and ester waxes. In the invention, an "ester wax" is a wax which has at least one ester bond on the molecule. Use may be made of a natural ester wax or a synthetic ester wax.

Examples of synthetic ester waxes include monoester waxes synthesized from a long-chain linear saturated aliphatic acid and a long-chain linear saturated aliphatic alcohol. The long-chain linear saturated fatty acid used is preferably one of the general formula $C_nH_{2n+1}COOH$, wherein n is at least 5 but not more than 28. The long-chain linear saturated aliphatic alcohol used is preferably one of the general formula $C_nH_{2n+1}OH$, wherein n is at least 5 but not more than 28. Examples of natural waxes include candelilla wax, carnauba wax, rice wax, and derivatives thereof.

Of these, more preferred waxes include synthetic ester waxes obtained from a long-chain linear saturated fatty acid and a long-chain linear saturated aliphatic alcohol, or natural waxes composed primarily of such an ester. Moreover, in the invention, in addition to the above linear structure, it is especially preferable for the ester to be a monoester.

In the practice of the invention, the use of a hydrocarbon wax is also preferred.

In the invention, the wax content in the toner is preferably at least 1.0 mass % but not more than 20.0 mass %, and more preferably at least 2.0 mass % but not more than 15.0 mass %. By adjusting the wax content in this range, the toner releasability can be further increased, making it difficult for sticking of the transfer paper to arise even when the fixing body has a low temperature. Moreover, because exposure of the wax on the toner surface can be set in a suitable state, it is possible to further enhance the heat-resistant storage stability.

In the invention, it is preferable for the wax to have a maximum endothermic peak, as measured by a differential scanning calorimetry (DSC), of preferably at least 60° C. but not more than 120° C., and more preferably at least 60° C. but not more than 90° C. By adjusting the maximum endothermic peak within the above range, the exposure of wax on the toner surface can be set in a suitable state, enabling the heat-resistant storage stability to be further enhanced. At the same time, the wax readily melts in an appropriate manner during fixing, enabling the low-temperature fixability and the offset resistance to be further improved.

<Colorant>

The toner of the invention requires a colorant in order to confer tinting strength. Colorants that are preferably used in the invention include the following organic pigments, organic dyes and inorganic pigments. Use may be made of colorants that are used in conventional toners. The colorants used in the inventive toner are selected from the standpoint of hue angle, chroma, lightness, lightfastness, OHP transparency, and dispersibility in toner.

Examples of colorants that may be used in the invention include the following.

Exemplary yellow colorants include condensed azo compounds, isoindolinone compounds, anthraquinone compounds, azo metal complexes, methine compounds and allylamide compounds. Illustrative examples include C.I. Pigment Yellow 12, 13, 14, 15, 17, 62, 74, 83, 93, 94, 95, 97, 109, 110, 111, 120, 128, 129, 138, 147, 150, 151, 154, 155, 168, 180, 185, 213 and 214. These may be used singly or two or more may be used in combination.

Exemplary magenta pigments include condensed azo compounds, diketopyrrolopyrrole compounds, anthraquinone and quinacridone compounds, basic dye lake compounds, naphthol compounds, benzimidazolone compounds, thioindigo compound and perylene compounds. Illustrative examples include C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269 and C.I. Pigment Violet 19. These may be used singly or two or more may be used in combination.

Exemplary cyan pigments include copper phthalocyanine compounds and derivatives thereof, anthraquinone compounds, and basic dye lake compounds. Illustrative examples include C.I. Pigment Blue 1, 7, 15, 15:1, 15:2, 15:3, 15:4, 60, 62 and 66. These may be used singly or two or more may be used in combination.

Exemplary black pigments include carbon blacks such as furnace black, channel black, acetylene black, thermal black and lamp black. Metal oxides such as magnetite and ferrite may also be used.

In the practice of the invention, when used as a colorant for an ordinary color toner, the colorant content with respect to the toner is preferably at least 2.0 mass % but not more than 15.0 mass %. By setting the colorant content in the above range, it is possible to enhance the tinting strength and also widen the color space. A colorant content of at least 2.5 mass % but not more than 12.0 mass % is more preferred. Together with an ordinary color toner, use can also be made of lightly coloring toners having a lowered concentration. In such a case, the colorant content with respect to the toner is preferably at least 0.5 mass % but not more than 5.0 mass %.

<External Additives>

It is desirable to add an inorganic fine powder as a flowability enhancer in the toner particles used in the invention. The inorganic fine powder added to the toner particles used in the invention is exemplified by fine powders such as silica fine powders, titanium oxide fine powders, alumina fine powders, and double oxide fine powders thereof. Of these inorganic fine powders, silica fine powders and titanium oxide fine powders are preferred.

Examples of silica fine powders include dry silica or fumed silica produced by the vapor phase oxidation of silicon halides, and wet silica produced from water glass. Dry silica having few silanol groups or little $Na_2O$ and $SO_3^{2-}$ on the surface and at the interior of the silica fine powder is preferred as the inorganic fine powder. Alternatively, the dry silica may be a composite fine powder of silica and some other metal oxide which is produced by using in the production step a metal halide compound such as aluminum chloride or titanium chloride together with the silicon halide compound. Specific examples of inorganic fine particles include the following.

Silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

The inorganic fine powder is preferably added externally to the toner particles in order to improve toner flowability and achieve a uniform charging performance. By subjecting the inorganic fine powder to hydrophobic treatment, it is possible to adjust the charge quantity of the toner, enhance the environmental stability of the toner, and improve the properties of the toner in a high-humidity environment. Hence, the use of inorganic fine powder that has been hydrophobic treated is more preferred. If the inorganic fine powder that has been added to the toner absorbs moisture, the charge quantity of the toner decreases, which tends to invite decreases in developing performance and transferability.

The treatment agent for hydrophobic treatment of the inorganic fine powder is exemplified by unmodified silicone varnish, various kinds of modified silicone varnish, unmodified silicone oils, various kinds of modified silicone oils, silane compounds, silane coupling agents, and other organosilicon compounds, as well as organotitanium compounds. These treatment agents may be used singly or in combinations thereof.

Of the above, an inorganic fine powder treated with a silicone oil is preferred. A hydrophobic-treated inorganic fine powder obtained by hydrophobic treatment of an inorganic fine powder with a coupling agent which is accompanied or followed by silicone oil treatment is more preferred because the charge quantity of the toner can be maintained at a high level even in a high-humidity environment, which is good for reducing selective development.

The amount of the above inorganic fine powder added per 100 parts by mass of the toner particles is preferably at least 0.1 parts by mass but not more than 4.0 parts by mass, and more preferably at least 0.2 parts by mass but not more than 3.5 parts by mass.

<Method of Manufacturing the Toner>

The toner of the invention has a core-shell structure having a shell phase formed on the surface of a core. Formation of the shell phase may be carried out simultaneous with the core forming step or may be carried out following formation of the core. Carrying out core formation and shell phase formation at the same time is simpler and more convenient, and is thus preferred.

The shell phase forming method is not subject to any particular limitation. In one such method, when a shell phase is provided following core formation, cores and resin fine particles are dispersed in an aqueous medium, following which the resin fine particles are made to aggregate on and adsorb to the core surface. The amount of the resin fine particles which form the shell phase is preferably at least 3.0 parts by mass but not more than 15.0 parts by mass per 100 parts by mass of the binder resin (the resin included in the core).

Also, it is especially preferable for the toner particles used in the invention to contain the Resin A included in the shell phase in an amount of at least 3.0 parts by mass but not more than 15.0 parts by mass per 100.0 parts by mass of the core. By adjusting the content of Resin A within the above range, the heat-resistant storage stability of the toner is further enhanced, in addition to which extraction of the binder resin suitably arises during fixing, enabling the low-temperature fixability to be further enhanced.

In the invention, methods that may be used to prepare toner particles having a core-shell structure include emulsion aggregation methods and dissolution suspension methods. Of these, a dissolution suspension method capable of preparing toner particles having a core-shell structure in a single step is preferred. In the dissolution suspension method, a resin composition obtained by dissolving in an organic medium the binder resin that becomes the core is dispersed in an aqueous medium in which the resin fine particles that become the shell phase have been dispersed. The organic medium is then removed, thereby giving toner particles.

The method of preparing the above resin fine particles is not particularly limited, and may be an emulsion polymerization method or may be a method that entails liquefying the resin by dissolution in a solvent or by melting, then suspending the liquefied resin in an aqueous medium. A known surfactant and dispersant may be used at this time, in addition to which the resin making up the fine particles may be conferred with self-emulsifiability.

Examples of solvents that may be used as the organic medium for dissolving the binder resin include hydrocarbon solvents such as xylene and hexane; halogenated hydrocarbon solvents such as methylene chloride, chloroform and dichloroethane; ester solvents such as methyl acetate, ethyl acetate, butyl acetate and isopropyl acetate; ether solvents such as diethyl ether; and ketone solvents such as acetone, methyl ethyl ketone, diisobutyl ketone, 2-butanone, cyclohexanone and methyl cyclohexane. Use may also be made of two or more of these. Combinations of such solvents include ethyl acetate and 2-butanone.

The aqueous medium used in the invention may be water alone, although a solvent that is miscible with water may also be used together. Examples of miscible solvents include alcohols (methanol, isopropanol, ethylene glycol), dimethylformamide, tetrahydrofuran, cellosolves (methyl cellosolve), and lower ketones (acetone, 1-butanone).

The method of dispersing the resin composition, etc. in the dispersion medium is not particular limited; use can be made of an ordinary dispersion apparatus, such as a low-speed shear disperser, high-speed shear dispersion, friction disperser, high-pressure jet disperser or ultrasonic disperser. Of these, a high-speed shear disperser is preferred. Ordinary equipment may be used as the emulsifier and the disperser.

Illustrative examples include continuous emulsifiers such as the Ultra-Turrax (IKA), Polytron (Kinematica), TK Autohomomixer (Tokushu Kika Kogyo), Ebara Milder (Ebara Corporation), TK Homomic Line Flow (Tokushu Kika Kogyo), colloid mills (Shinko Pantec), Slasher, Trigonal Wet Pulverizer (Mitsui Miike Chemical Engineering Machinery), Cavitron (Eurotec) and Fine Flow Mill (Taiheiyo Kiko); and emulsifiers for either batch-type or continuous operation, such as Clearmix (M-Technique Co., Ltd.) and FILMICS (Tokushu Kika Kogyo).

In cases where a high-speed shear disperser is used, although not particularly limited, the rotational speed is generally at least 1,000 rpm but not more than 30,000 rpm, and preferably at least 3,000 rpm but not more than 30,000 rpm. The dispersion time in the case of a batch-type system is generally at least 0.1 minute but not more than 5 minutes. The temperature during dispersion is generally at least 10° C. but not more than 55° C., and preferably at least 10° C. but not more than 40° C.

In the production of the toner particles of the invention, it is preferable to use carbon dioxide in a supercritical state or a liquid state rather than an aqueous medium as the dispersion medium for the dissolution suspension method. That is, it is preferable for the toner particles to be formed by the steps of: (I) preparing a resin composition by dissolving or dispersing the binder resin, the colorant and the wax in an organic solvent-containing medium; (II) preparing a dispersion by dispersing the resin composition in a dispersion medium containing carbon dioxide in a supercritical or liquid state where resin fine particles containing resin (A) are dispersed; and (III) removing the organic solvent from the dispersion. This is a method wherein granulation is carried out by dispersing the above resin composition in carbon dioxide in a supercritical or liquid state obtained by applying high pressure to carbon dioxide, then the organic solvent present in the granulated particles is extracted into the carbon dioxide phase and thereby removed, following which the pressure is released, thereby separating the carbon dioxide from the particles by allowing the carbon dioxide to vaporize, and yielding toner particles.

By using carbon dioxide in a liquid state or a supercritical state as the dispersion medium, a hydrophobic toner material which blends well with carbon dioxide readily orients on the surface of the toner particles, as a result of which the surface of the toner particles thus obtained readily becomes hydrophobic. Therefore, because the toner produced by this method does not easily adsorb moisture in air, the ambient stability of the toner charge can be further enhanced.

Here, "carbon dioxide in a liquid state" refers to carbon dioxide under temperature and pressure conditions within the area enclosed by the gas-liquid boundary line which passes through the triple point in the phase diagram for carbon dioxide (temperature=−57° C., pressure=0.5 MPa) and the critical point (temperature=31° C., pressure=7.4 MPa), the isotherm at the critical temperature and the solid-liquid boundary line. Also, "carbon dioxide in a supercritical state" refers to carbon dioxide under temperature and pressure conditions at or above the carbon dioxide critical point. Also, the dispersion medium is preferably composed primarily (i.e., 50 mass % or more) of carbon dioxide in a high-pressure state.

In the invention, an organic solvent may be included as another component in the dispersion medium. In such a case, it is preferable for the carbon dioxide and the organic solvent to form a homogeneous phase.

In such a method, granulation is carried out under a high pressure. This is especially preferable because the crystallinity of the crystalline polyester is easily maintained and may even be further increased.

An example of a method for producing toner particles using carbon dioxide in a liquid or supercritical state as the dispersion medium which is highly suitable for obtaining the toner particles of the invention is described below.

First, a binder resin, a colorant, a wax and other optional additives are added to an organic solvent capable of dissolving the binder resin, and the system is uniformly dissolved or dispersed with a disperser such as a homogenizer, ball mill, colloid mill, or ultrasonic disperser. Next, the dissolution or dispersion thus obtained (sometimes referred to below simply as the "binder resin solution") is dispersed in carbon dioxide in a liquid or supercritical state, thereby forming liquid drops.

It is preferable at this time to disperse a dispersant within the carbon dioxide in a liquid or supercritical state which serves as the dispersion medium. A resin fine particle dispersion is used as the dispersant. The dispersant that has adsorbed to the surface of the oil droplets remains behind after toner particle formation, enabling toner particles coated on the surface with resin fine particles to be formed.

Because the toner particles are formed with a core-shell structure, the particle size of the fine particles of Resin A, expressed as the volume-average particle diameter, is preferably at least 5 nm but not more than 500 nm, and more preferably at least 50 nm but not more than 300 nm. By setting the particle size of the Resin A fine particles within this range, the stability of the oil droplets during granulation can be further increased, facilitating control of the oil droplet particle size to the desired size.

In the invention, any suitable method may be used to disperse the above dispersant in carbon dioxide in a liquid or supercritical state. One exemplary method involves charging the dispersant and the carbon dioxide in a liquid or supercritical state into a vessel, and directly effecting dispersion by agitation or ultrasonic irradiation. Another method involves the use of a high-pressure pump to inject an organic solvent dispersion of the dispersant into a vessel that has been charged with carbon dioxide in a liquid or supercritical state.

Moreover, in this invention, any method may be used to disperse the binder resin solution in carbon dioxide in a liquid or supercritical state. One exemplary method involves the use of a high-pressure pump to inject the binder resin solution into a vessel containing carbon dioxide in a liquid or supercritical state within which the dispersant has been dispersed. Another method involves introducing carbon dioxide in a liquid or supercritical state within which the dispersant has been dispersed into a vessel that has been charged with the binder resin solution.

In the practice of the invention, it is important that the dispersion medium obtained using carbon dioxide in a liquid or supercritical state be composed of a single phase. When granulation is carried out by dispersing the binder resin solution in carbon dioxide in a liquid or supercritical state, a portion of the organic solvent within the oil droplets migrates into the dispersion. It is undesirable at this time for the carbon dioxide phase and the organic solvent phase to exist in a separated state because this causes a loss of oil droplet stability. Therefore, the temperature and pressure of the dispersion medium and the amount of the resin binder solution with respect to the carbon dioxide in a liquid or supercritical state are preferably adjusted within ranges where the carbon dioxide and the organic solvent can be formed into a homogenous phase.

In setting the temperature and pressure of the dispersion medium, attention must also be paid to the granulating ability (ease of oil particle formation) and the solubility in the dispersion medium of the constituent components within the binder resin solution. For example, depending on the temperature or pressure conditions, the binder resin and wax within the binder resin solution may dissolve in the dispersion medium. Generally, at lower temperature and pressure, the solubility of these components in the dispersion medium is suppressed, but the oil droplets that have formed readily condense and coalesce, lowering the granulating ability. On the other hand, at higher temperature and pressure, the granulating ability increases, but the above components tend to readily dissolve in the dispersion medium.

It is also possible to obtain the carbon dioxide in a liquid state or supercritical state by setting it to a low pressure and a high temperature, although setting it to a low temperature and a high pressure is preferable for lowering the influence by temperature on the toner material.

Specifically, with respect to the temperature of the dispersion medium, in cases where a crystalline polyester component is used as the toner material, to avoid a loss in the crystallinity of the crystalline polyester component, it is preferable to set the temperature lower than the melting point of the crystalline polyester component.

Hence, in the production of toner particles in the invention, the temperature of the dispersion medium is preferably at least 10° C. but not more than 40° C.

The pressure within the vessel where the dispersion medium is formed is preferably at least 1.0 MPa but not more than 20.0 MPa, and more preferably at least 2.0 MPa but not more than 15.0 MPa. In the invention, when a component other than carbon dioxide is included in the dispersion medium, "pressure" refers to the total pressure.

The proportion of carbon dioxide within the dispersion medium in the invention is preferably at least 70 mass %, more preferably at least 80 mass %, and even more preferably at least 90 mass %.

Following the completion of such granulation, the organic solvent remaining in the oil droplets is removed by means of the dispersion medium containing carbon dioxide in a liquid or supercritical state. Specifically, such removal is carried out by mixing additional carbon dioxide in a liquid or supercritical state into the dispersion medium in which the oil droplets have been dispersed, extracting the residual organic solvent into the carbon dioxide phase, and replacing the carbon dioxide containing this organic solvent with fresh carbon dioxide in a liquid or supercritical state.

Mixture of the dispersion medium and the carbon dioxide in a liquid or supercritical state may be carried out by adding to the dispersion carbon dioxide in a liquid or supercritical state obtained by the application of a higher pressure than the dispersion medium, or by adding the dispersion medium to carbon dioxide in a liquid or supercritical state obtained by the application of a lower pressure than the dispersion medium.

The method of replacing the organic solvent-containing carbon dioxide with carbon dioxide in a liquid or supercritical state is exemplified by a method in which carbon dioxide in a liquid or supercritical state is passed through the vessel while holding the interior of the vessel at a constant pressure. This is carried out while using a filter to collect the toner particles that form.

In a state where substitution with carbon dioxide in a liquid or supercritical state is inadequate or organic solvent remains within the dispersion medium, there are times where, when the pressure of the vessel is reduced in order to recover the toner particles that have formed, the organic solvent dissolved within the dispersion medium condenses, leading to undesirable effects such as re-dissolution of the toner particles or coalescence of the toner particles. Therefore, substitution with carbon dioxide in a liquid or supercritical state must be carried out until the organic solvent has been completely removed. The amount of carbon dioxide in a liquid or supercritical state which is passed through is preferably at least one time but not more than 100 times, more preferably at least one time but not more than 50 times, and most preferably at least one time but not more than 30 times, the volume of the dispersion medium.

When reducing the pressure of the vessel and removing the dispersed toner particles from the dispersion containing carbon dioxide in a liquid or supercritical state, the temperature and pressure may be lowered in a single operation to normal temperature and pressure, or the pressure may be reduced in a stepwise manner by providing vessels in a plurality of stages, each of the vessels being independently pressure-controlled. The rate of pressure reduction is preferably set within a range where foaming of the toner particles does not occur. Also, the organic solvent and the carbon dioxide in a liquid or supercritical state used in the invention may be recycled.

The inventive toner preferably has, in gel permeation chromatography (GPC) of the tetrahydrofuran (THF)-soluble matter, a number-average molecular weight (Mn) of at least 5,000 but not more than 40,000, and a weight-average molecular weight (Mw) of at least 15,000 but not more than 60,000. Within these ranges, a good heat-resistant storage stability can be maintained, and sharp melting properties suitable for the toner can be conferred. The Mn is more preferably at least 7,000 but not more than 25,000, and the Mw is more preferably at least 20,000 but not more than 50,000. In addition, the ratio Mw/Mn is preferably 6 or less, and more preferably 4 or less.

Methods for measuring the various physical properties of the toner and toner material of the invention are described below.

<Method of Determining Peak Temperature of Maximum Endothermic Peak>

The peak temperature of the maximum endothermic peak in the invention is measured under the following conditions using a Q1000 differential scanning calorimetry (manufactured by TA Instruments).

Ramp-up rate: 10° C./min

Measurement start temperature: 20° C.

Measurement end temperature: 180° C.

Temperature calibration for the apparatus detector is carried out using the melting points of indium and zinc. Heat quantity calibration is carried out using the heat of fusion for indium.

A specimen of about 5 mg is precisely weighed, then placed in a silver pan and a single measurement is carried out. The empty silver pan is used as the reference. In this invention, the peak temperature of the maximum endothermic peak in the first temperature rise by Resin A is referred to as TpA (° C.).

The "melting point" of a substance having crystallinity (e.g., crystalline polyester) in the invention is the peak temperature of the maximum endothermic peak at the first temperature rise by the substance having crystallinity in the above method.

In cases where Resin A having no segments capable of forming a crystalline structure is used, the glass transition temperature of Resin A is TpA. The glass transition temperature is determined as follows. Using the reversing heat flow curve during temperature rise obtained in the above DSC measurement, tangents to the curve representing an endothermic event and to the baseline on either side are drawn. The glass transition temperature is defined as the midpoint of a straight line connecting the intersections of the respective tangents.

<Method of Measuring Loss Elastic Modulus G">

In the invention, the loss elastic modulus G" is measured using an ARES rheometer (Rheometrics Scientific). The method of measurement, which is briefly described in the ARES operating manuals 902-30004 (August 1997 edition) and 902-00153 (July 1993 edition) published by Rheometrics Scientific, is as follows.

Measurement jig: torsion rectangular

Measurement sample: The resin used as the shell phase is fashioned with a pressure molding machine into a rectangular sample having a width of about 12 mm, a height of about 20 mm and a thickness of about 2.5 mm (and held for 1 minute at normal temperature and 15 kN). The pressure molding machine used is a 100 kN press NT-100H (from NPa System).

The jig and the sample are left to stand at normal temperature (23° C.) for 1 hour, following which the sample is mounted on the jig (see FIG. 1). As shown in the diagram, the sample is fixed in such a way as to set the dimensions of the measurement area to a width of about 12 mm, a thickness of about 2.5 mm, and a height of 10 mm. The temperature is adjusted over 10 minutes to a measurement starting temperature of 30° C., after which measurement is carried out under the following settings.

Measurement frequency: 6.28 radian/s

Measurement strain setting: Initial value is set to 0.1%, and measurement is carried out in automated measurement mode Sample elongation correction: Adjusted in automated measurement mode Measurement temperature: Temperature is increased from 30° C. to 150° C. at a rate of 2° C./min Measurement interval: Viscoelastic data is measured at 30-second intervals; that is, at 1° C. intervals Data is transferred via an interface to an RSI Orchestrator (control, data collection and analysis software (Rheometrics Scientific)) operating on Windows 2000 (Microsoft Corporation).

The loss elastic modulus values G"a(TpA−10), G"a(TpA), G"a(TpA+10) and G"a(TpA+25) at the respective temperatures TpA−10 (° C.), TpA (° C.), TpA+10 (° C.) and TpA+25 (° C.) with respect to the TpA determined by the above "Method of Measuring Peak Temperature of Maximum Endothermic Peak" are read off from this data.

Figure 2:
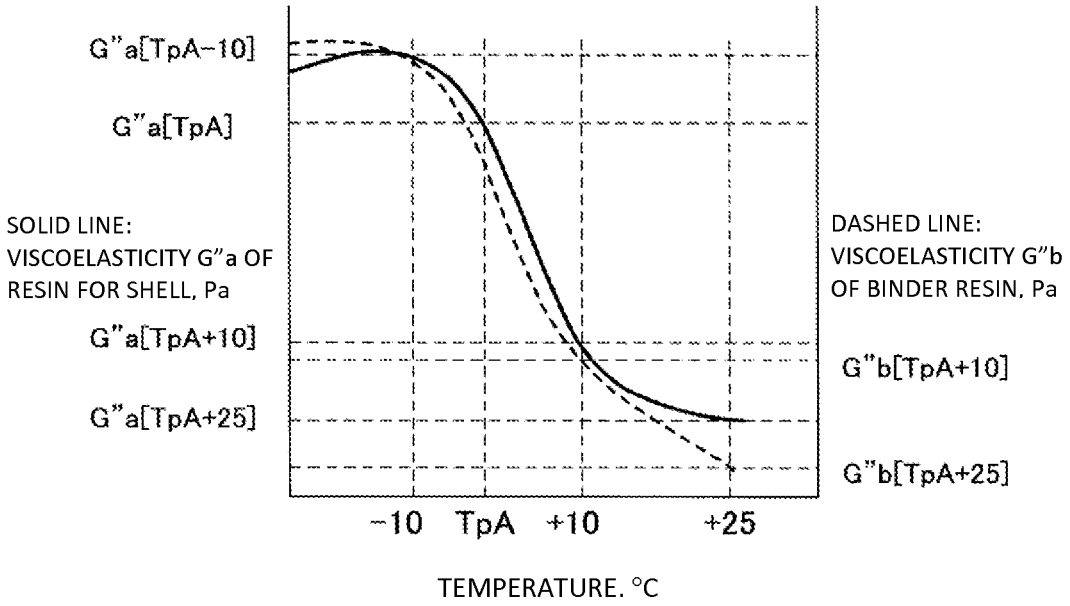
FIG. 2 is a diagram showing the viscoelasticity of toners according to the invention.

Measurement is similarly carried out as well on the binder resin used as the core, and the loss elastic modulus values G"b(TpA+10) and G"b(TpA+25) at the respective temperatures TpA+10 (° C.) and TpA+25 (° C.) are read off. See FIG. 2.

<Methods of Measuring Weight-Average Particle Diameter (D4) and Number-Average Particle Diameter (D1)>

The weight-average particle diameter (D4) and number-average particle diameter (D1) of the toner are calculated as follows. The measurement apparatus is a precision analyzer for particle characterization based on the pore electrical resistance method and equipped with a 100 μm aperture tube (Coulter Counter Multisizer 3®, manufactured by Beckman Coulter). Dedicated software (Beckman Coulter Multisizer 3, Version 3.51 (from Beckman Coulter)) furnished with the device is used for setting the measurement conditions and analyzing the measurement data. Measurement is carried out with the following number of effective measurement channels: 25,000.

The aqueous electrolyte solution used in measurement is a solution obtained by dissolving sodium chloride (guaranteed reagent) in ion-exchanged water to a concentration of about 1 mass %, such as "ISOTON II" (Beckman Coulter).

Prior to carrying out measurement and analysis, the following settings are carried out in the software.

From the "Changing Standard Operating Mode (SOM)" screen of the software, select the Control Mode tab and set the Total Count to 50,000 particles, the Number of Runs to 1, and the Kd value to the value obtained using "Standard particle 10.0 μm" (Beckman Coulter). Pressing the "Threshold/Noise Level Measuring Button" automatically sets the threshold and noise levels. Set the Current to 1,600 μA, the Gain to 2, and the Electrolyte to ISOTON II, and place a check mark by "Flush aperture tube following measurement."

In the "Convert Pulses to Size" screen of the software, set the Bin Spacing to "Log Diameter," the Size Bins to 256, and the particle diameter range to from 2 μm to 60 μm.

The measurement method is as follows.

(1) About 200 mL of the above aqueous electrolyte solution is placed in a 250 mL glass round-bottomed beaker for the Multisizer 3, the beaker is set on the sample stand, and stirring is carried out counterclockwise with a stirrer rod at a speed of 24 rotations per second. The "Aperture Flush" function in the software is then used to remove debris and air bubbles from the aperture tube.

(2) About 30 mL of the aqueous electrolyte solution is placed in a 100 mL glass flat-bottomed beaker. About 0.3 mL of a dilution obtained by diluting the dispersant "Contaminon N" (a 10 mass % aqueous solution of a neutral (pH 7) cleanser for cleaning precision analyzers composed of a nonionic surfactant, a anionic surfactant and an organic builder; available from Wako Pure Chemical Industries, Ltd.) about 3-fold by weight with ion-exchanged water is added to the electrolyte solution.

(3) A Tetora 150 ultrasonic dispersion system (Nikkaki Bios) having an electrical output of 120 W and equipped with two oscillators which oscillate at 50 kHz and are configured at a phase offset of 180 degrees is prepared for use. About 3.3 L of ion-exchanged water is placed in the water tank of the system, and about 2 mL of Contaminon N is added to the tank.

(4) The beaker prepared in (2) above is set in a beaker-securing hole of the ultrasonic dispersion system, and the system is operated. The beaker height position is adjusted so as to maximize the resonance state of the aqueous electrolyte solution liquid level within the beaker.

(5) The aqueous electrolyte solution within the beaker in (4) above is subjected to ultrasonic irradiation while about 10 mg of toner is added a little at a time to the solution. Ultrasonic dispersion treatment is then continued for 60 seconds suitably regulating operation so that the water temperature in the tank is at least 10° C. but not more than 40° C.

(6) The dispersed toner-containing aqueous electrolyte solution in (5) is added dropwise with a pipette to the round-bottomed beaker in (1) above that has been set in the sample stand, and the measurement concentration is adjusted to about 5%. Measurement is then continued until the number of measured particles reaches 50,000.

(7) Analysis of the measurement data is carried out using the dedicated software provided with the Multisizer 3 system, and the weight-average particle diameter (D4) and the number-average particle diameter (D1) are computed. When "Graph/Vol %" is selected in the software program, the "average size" in the "Analysis/Volume Statistics (Cumulative Average)" pane is the weight-average particle diameter (D4). When "Graph/No %" is selected, the "average size" in the "Analysis/Number Statistics (Cumulative Average)" pane is the number-average particle diameter (D1).

<Methods of Measuring Number-Average Molecular Weight (Mn) and Weight-Average Molecular Weight (Mw) by Gel Permeation Chromatography (GPC)>

The number-average molecular weight (Mn) of the resin is measured by gel permeation chromatography (GPC), and the weight-average molecular weight (Mw) of the resin is measured based on the tetrahydrofuran (THF) soluble matter by GPC using THF as the solvent. The measurement conditions are as follows.

(1) Preparation of Measurement Sample:

Resin (as the sample) and THF are mixed to a concentration of about 0.5 to 5 mg/mL (for example, 5 mg/mL) and left at room temperature for several hours (for example, 5 to 6 hours), following which they are thoroughly shaken, and the THF and sample are mixed well until the coalesce of the sample was fully dispersed. The dispersion is left at rest for at least 12 hours (for example, 24 hours) at room temperature. The length of time from the moment that mixing of the sample and THF begins until the moment that standing of the mixture ends is set to at least 24 hours.

The mixture is then passed through a sample treatment filter (pore size, 0.45 to 0.5 μm; MyShoriDisk H-25-2 (Tosoh Corporation) and Ekicrodisc (Gelman Sciences Japan, Ltd., can be suitably used), and the filtered mixture is used as the GPC sample.

(2) Sample Measurement:

The column is stabilized in a 40° C. heat chamber and, while passing THF as the solvent at a flow rate of 1 mL per minute through the column at this temperature, 50 to 200 μL of a THF sample solution of the resin adjusted to a sample concentration of 0.5 to 5 mg/mL is poured in and measured.

The molecular weight of the sample was measured by calculating the molecular weight distribution of the sample from the relationship between the logarithmic values and counts on a calibration curve prepared using several types of monodispersed polystyrene standard samples.

The standard polystyrene samples used for calibration curve preparation are samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ produced by Pressure Chemical Co. or Toyo Soda Kogyo. The detector used is a refractive index (RI) detector.

As for the columns, in order to carry out suitable measurement in a molecular weight range from $1\times10^3$ to $2\times10^6$, a plurality of commercial polystyrene gel columns are used in combination as indicated below. In the invention, the GPC measurement conditions are as follows.

GPC Measurement Conditions:

Apparatus: LC-GPC 150C (Waters Associates, Inc.)

Columns: A series of seven connected columns KF801, 802, 803, 804, 805, 806, 807 (Shodex)

Column temperature: 40° C.

Mobile phase: (THF) tetrahydrofuran

<Method of Measuring Particle Sizes of Colorant Particles, Wax Particles and Shell-Forming Resin Fine Particles>

Particle size measurement of the various above fine particles is carried out, as the volume-average particle diameter (μm or nm), using a Microtrac Particle Size/Distribution Analyzer HRA (X-100, from Nikkiso) at a particle diameter range setting of from 0.001 μm to 10 μm. Water was selected as the diluting medium.

<Method of Measuring Acid Value of Resin>

The acid value is the number of milligrams of potassium hydroxide needed to neutralize the acid included in 1 g of the resin sample. The acid value of the resin is measured in general accordance with JIS K 0070-1966. Measurement is carried out according to the following procedure.

(1) <Preparation of Reagent>

Phenolphthalein (1.0 g) is dissolved in 90 mL of ethyl alcohol (95 vol %), then ion-exchanged water is added up to 100 mL to give a phenolphthalein solution.

Potassium hydroxide (guaranteed reagent, 7 g) is dissolved in water, then ethyl alcohol (95 vol %) is added up to 1 liter. This solution is placed in an alkali-resistant vessel without allowing the solution to come into contact with carbon dioxide, and is left to stand for 3 days, then filtered, giving a potassium hydroxide solution. The resulting potassium hydroxide solution is stored in an alkali-resistant vessel. Standardization is carried out in accordance with JIS K 0070-1996.

(2) <Operation>

(A) Actual Test:

An amount of 2.0 g of a crushed resin sample is accurately weighed in a 200 mL Erlenmeyer flask, 100 mL of a toluene/ethanol (2:1) mixed solution is added, and dissolution is effected over 5 hours. Next, several drops of the phenolphthalein solution are added as an indicator, and titration is carried out using the potassium hydroxide solution. The titration endpoint is when the faint red color of the indicator persists for about 30 seconds.

(B) Blank Test:

Aside from not using a sample (that is, using only the toluene/ethanol (2:1) mixed solution), the same titration as in the above procedure is carried out.

(3) The acid value is calculated by substituting the results obtained into the following formula.

$$A=\{(B-C)\cdot f\cdot 5.61\}/S$$

In the formula, A is the acid value (mgKOH/g), B is the amount (mL) of potassium hydroxide solution added in the blank test, C is the amount (mL) of potassium hydroxide solution added in the actual test, f is a potassium hydroxide solution factor, and S is amount of sample (g).

<Method of Calclating Proportion (mass %) of Segments Capable of Adopting a Crystal Structure>

The proportion (mol %) of segments capable of forming a crystalline structure in the binder resin is measured by $^1$H-NMR under the following conditions.

Measurement apparatus: FT NMR (JNM-EX400, from JEOL Ltd.)

Measurement frequency: 400 MHz

Pulse conditions: 5.0 μs

Frequency range: 10,500 Hz

Number of runs: 64

Measurement temperature: 30° C.

The sample is prepared by placing 50 mg of block polymer in a sample tube having an inside diameter of 5 mm, adding heavy chloroform ($CDCl_3$) as the solvent, and dissolving in a 40° C. thermostatic tank. On the resulting $^1$H-NMR chart, of the peaks assigned to constituent features of the segments capable of forming a crystalline structure, a peak that is independent of peaks assigned to the other features is selected, and the integrated value $S_1$ for that peak is computed. Similarly, of the peaks assigned to constituent features of the non-crystalline segments, a peak that is independent of peaks assigned to the other features is selected, and the integrated value $S_2$ for that peak is computed. The proportion of segments capable of forming a crystalline structure is determined as follows using the above integrated values $S_1$ and $S_2$. In addition, $n_1$ and $n_2$ are the number of hydrogens in the constituent features to which peaks have been assigned.

$$\text{Proportion (mol \%) of segments capable of forming a crystalline structure}=\{(S_1/n_1)/(S_1/n_1)+(S_2/n_2))\}\times 100$$

The proportion (mol %) of the segments capable of forming a crystalline structure as determined in this manner is converted to mass % using the molecular weights of the respective components.

EXAMPLES

The invention is described in greater detail below by way of examples, although the invention is not restricted by these examples. Unless noted otherwise, all parts and percent (%) mentioned in the examples and the comparative examples are by mass.

Synthesis Example for Crystalline Polyester 1

| | |
|---|---|
| Sebacic acid | 111.0 parts by mass |
| Adipic acid | 20.5 parts by mass |
| 1,4-Butanediol | 68.5 parts by mass |
| Dibutyltin oxide | 0.1 parts by mass |

A reaction vessel equipped with a stirrer and a thermometer was charged with the above components under nitrogen flushing. The interior of the system was flushed with nitrogen drawn in under vacuum operation, following which the contents were stirred at 250° C. for 1 hour. When the contents had acquired a viscous state, the system was air-cooled, thereby stopping the reaction and yielding Crystalline Polyester 1. The physical properties of Crystalline Polyester 1 are shown in Table 1.

Synthesis Examples for Crystalline Polyesters 2 to 5

Aside from changing the amounts in which the acid and alcohol components were charged as shown in Table 1, Crystalline Polyesters 2 to 5 were synthesized in the same way as in the synthesis example for Crystalline Polyester 1. The properties of Crystalline Polyesters 2 to 5 are shown in Table 1.

Synthesis Example for Crystalline Polyester 6

| | |
|---|---|
| Sebacic acid | 105.0 parts by mass |
| Adipic acid | 28.0 parts by mass |
| 1,4-Butanediol | 67.0 parts by mass |
| Dibutyltin oxide | 0.1 parts by mass |

A reaction vessel equipped with a stirrer and a thermometer was charged with the above components under nitrogen flushing. The interior of the system was flushed with nitrogen drawn in under vacuum operation, following which the contents were stirred at 180° C. for 6 hours. Next, while stirring was continued, the temperature was gradually raised to 230° C. in vacuo and that state was maintained for another 2 hours. When the contents had acquired a viscous state, the system was air-cooled, thereby stopping the reaction and yielding Crystalline Polyester 6. The properties of Crystalline Polyester 6 are shown in Table 1.

<Synthesis of Non-Crystalline Polyester 1>

The following starting materials were charged into a heat-dried two-necked flask while introducing nitrogen.

| | |
|---|---|
| Polyoxypropylene (2.2)-2,2-bis (4-hydroxyphenyl)propane | 30.0 parts by mass |
| Polyoxyethylene (2.2)-2,2-bis (4-hydroxyphenyl)propane | 33.0 parts by mass |
| Terephthalic acid | 21.0 parts by mass |
| Trimellitic anhydride | 1.0 part by mass |
| Fumaric acid | 3.0 parts by mass |
| Dodecenylsuccinic acid | 12.0 parts by mass |
| Dibutyltin oxide | 0.1 parts by mass |

A reactor vessel equipped with a stirrer and a thermometer was charged, under nitrogen flushing, with the above components. Stirring was carried out at 215° C. for 5 hours. Next, while stirring was continued, the temperature was gradually raised to 230° C. in vacuo and that state was maintained for another 2 hours. When the contents had acquired a viscous state, the system was air-cooled, thereby stopping the reaction and yielding Non-Crystalline Polyester 1. Non-Crystalline Polyester 1 had a number-average molecular weight Mn of 7,200, a weight-average molecular weight Mw of 43,000, and a glass transition temperature Tg of 63° C.

Synthesis Example for Block Polymer 1

| | |
|---|---|
| Crystalline Polyester 6 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300.0 parts by mass |

A reactor vessel equipped with a stirrer and a thermometer was charged, under nitrogen flushing, with the above components. The contents were heated at 50° C. and a urethane-forming reaction was carried out over a period of 15 hours. Next, 3.0 parts by mass of salicylic acid was added, and the isocyanate ends were modified. The THF serving as the solvent was distilled off, giving Block Polymer 1. The physical properties of the block polymer are shown in Table 2.

Synthesis Examples for Block Polymers 2 to 4

Aside from changing the materials, amounts and reaction conditions as shown in Table 2, Block Polymers 2 to 4 were obtained in the same way as in the synthesis example for Block Polymer 1. The physical properties of Block Polymers 2 to 4 are shown in Table 2.

Synthesis Example for Vinyl Monomer a1

| | |
|---|---|
| Xylylene diisocyanate (XDI) | 59.0 parts by mass |

A reaction vessel equipped with a stirrer and a thermometer was charged with the above, then 41.0 parts by mass of 2-hydroxyethyl methacrylate (2-HEMA) was added dropwise and the reaction was carried out at 55° C. for 4 hours, yielding a Vinyl Monomer Intermediate a1.

| | |
|---|---|
| Crystalline Polyester 1 | 83.0 parts by mass |
| Tetrahydrofuran | 100.0 parts by mass |

A reaction vessel equipped with a stirrer and a thermometer was charged with the above materials under nitrogen flushing, and dissolution was carried out at 50° C. Vinyl Monomer Intermediate a1 (10 parts by mass) was then added dropwise and the reaction was effected at 50° C. for 4 hours, giving a Vinyl Monomer a1 solution. Next, the tetrahydrofuran was removed under reduced pressure at 40° C. for 5 hours with a rotary evaporator, giving the Vinyl Monomer a1.

Synthesis Examples for Vinyl Monomers a2 to a5

Vinyl Monomers a2 to a5 were obtained by using, in the synthesis example for Vinyl Monomer a1, the materials shown in Table 3 in the indicated amounts rather than Crystalline Polyester 1.

Preparation of Vinyl Monomer a6

Commercial behenyl acrylate, which is a vinyl monomer containing a linear alkyl group in the molecular structure (the alkyl group having 22 carbons) was prepared, and used as Vinyl Monomer a6.

Synthesis Example for Shell Resin Dispersion 1

| | |
|---|---|
| Vinyl monomer having organic polysiloxane structure (X-22-2475, from Shin-Etsu Chemical) | 15.0 parts by mass |
| Vinyl Monomer al | 40.0 parts by mass |
| Styrene (St) | 37.5 parts by mass |
| Methacrylic acid (MAA) | 7.5 parts by mass |
| Azobismethoxydimethylvaleronitrile | 0.3 parts by mass |
| n-Hexane | 80.0 parts by mass |

The above materials were charged, under nitrogen flushing, into a reaction vessel equipped with a stirrer and a thermometer. A monomer solution was prepared by stirring and mixture at 20° C., and introduced into a dropping funnel that had been heat-dried beforehand. In a separate procedure, 300 parts by mass of n-hexane was charged into a heat-dried two-necked flask. After flushing the flask with nitrogen, the dropping funnel was mounted on the flask and the monomer solution was added dropwise under closed conditions at 40° C. over a period of 1 hour. Following the completion of dropwise addition, stirring was continued for 3 hours, then 0.3 parts by mass of azobismethoxydimethylvaleronitrile and 20.0 parts by mass of n-hexane were added dropwise, and stirring was carried out at 40° C. for 3 hours. The flask contents were subsequently cooled to room temperature, giving Shell Resin Dispersion 1 having a solids content of 20.0 mass %. The volume-average particle diameter of the resin fine particles in Shell Resin Dispersion 1 is shown in Table 4.

The vinyl monomer XX-22-2475 having an organic polysiloxane structure is a vinyl monomer with a structure where, in above Chemical Formula (1), $R_1$ is a methyl group, $R_2$ is a methyl group, $R_3$ is a propylene group, $R_4$ is a methyl group and n is 3.

Next, the n-hexane was removed from a portion of Shell Resin Dispersion 1 under reduced pressure at 40° C. for 5 hours with a rotary evaporator, giving Shell Resin A1. DSC measurement was carried out on Shell Resin A1, whereupon the peak temperature for the maximum endothermic peak was confirmed to be 61° C. Also, measurement of the viscoelasticity of the Shell Resin A was carried out based on the <Method of Measuring Loss Elastic Modulus G"> described above. Properties relating to the loss elastic modulus of the Shell Resin A1 are shown in Table 7.

The number-average molecular weight and weight-average molecular weight of Shell Resin A1 were measured based on the "Method of Measuring the Number-Average Molecular Weight Mn and the Weight-Average Molecular Weight Mw by Gel Permeation Chromatography (GPC)." The results are shown in table 4.

Synthesis Examples for Shell Resin Dispersions 2 to 25

Shell Resin Dispersions 2 to 25 were obtained by using, in the synthesis example for Shell Resin Dispersion 1, the compositions and amounts of Vinyl Monomer-a and Vinyl Monomer-b shown in Table 4. The volume-average particle diameters of the resin fine particles in Shell Resin Dispersions 2 to 25 are shown in Table 4.

Next, the n-hexane was removed from a portion of each of Shell Resin Dispersions 2 to 25 under reduced pressure at 40° C. for 5 hours with a rotary evaporator, giving Shell Resins A2 to A25, the properties of which were measured in the same way as for Shell Resin A1. Those properties are shown in Table 4 and 7.

Preparation Example for Shell Resin Dispersion 26

| | |
|---|---|
| Non-Crystalline Polyester 1 | 100.0 parts by mass |
| Ionic surfactant Neogen RK (Dai-Ichi Kogyo Seiyaku) | 5.0 parts by mass |
| Ion-exchanged water | 400.0 parts by mass |

The above components were mixed and heated to 100° C., thoroughly dispersed with an Ultra-Turrax T50 (manufactured by IKA), then subjected to 1 hour of dispersion treatment in a pressure discharge-type Gaulin homogenizer, giving Shell Resin Dispersion 26 having a volume-average particle diameter of 180 nm and a solids content of 20.0 mass %.

Next, a portion of Shell Resin Dispersion 26 was removed and subjected to filtration and drying, giving Shell Resin A26. DSC measurement was carried out on Shell Resin A26, confirming that a peak from crystalline structure is not observable. The glass transition temperature was determined from the reversing heat flow curve during temperature rise that was obtained from DSC measurement, and TpA was found to be 63° C. In addition, the viscoelasticity of Shell Resin A26 was measured based on the <Method of Measuring Loss Elastic Modulus G"> described above. The properties for Shell Resin A26 are shown in Table 7.

Preparation Example for Core Resin Solution 1

| | |
|---|---|
| Block Polymer 1 | 100.0 parts by mass |
| Acetone | 100.0 parts by mass |

The above materials were placed in a closed vessel equipped with stirring blades, the temperature was raised to 70° C., and the vessel contents were stirred at 3,000 rpm for 30 minutes, following which the contents were cooled to room temperature, giving Core Resin Solution 1. The solvent was removed from a portion of Core Resin Solution 1 under reduced pressure at 40° C. for 5 hours, giving Core Resin 1. The viscoelasticity of Core Resin 1 was measured based on the <Method of Measuring Loss Elastic Modulus G"> described above. Using the above-described "Method of Calculating the Proportion (Wt %) of Segments Capable of Adopting a Crystal Structure," the content of segments capable of forming a crystalline structure within the Core Resin 1 was confirmed to be 70 mass %. The properties of Core Resin 1 are shown in Tables 5 and 7.

Preparation Examples for Core Resin Solution 2 to 9

Core Resin Solutions 2 to 9 were obtained by changing Block Polymer 1 in the preparation example for Core Resin Solution 1 to the materials and amounts thereof and the solvents shown in Table 5. Solvent was removed from a portion of each of Core Resin Solutions 2 to 9 under reduced pressure at 40° C. for 5 hours, thereby giving Core Resins 2 to 9. The properties of Core Resins 2 to 9 are shown in Tables 5 and 7.

Preparation Example for Wax Dispersion 1

| | |
|---|---|
| Paraffin wax HNP9 (melting point, 76° C.; Nippon Seiro) | 50.0 parts by mass |
| Wax dispersant (copolymer with peak molecular weight of 8,500 obtained by graft copolymerizing 50.0 parts by mass of styrene, 25.0 parts by mass of n-butyl acrylate and 10.0 parts by mass of acrylonitrile in the presence of 15.0 parts by mass of polyethylene) | 25.0 parts by mass |
| Acetone | 175.0 parts by mass |

The above components were charged into a glass beaker (Iwaki Glass) equipped with stirring blades, and the wax was dissolved in the acetone by heating the interior of the system to 80° C. Next, the system interior was gradually cooled under gentle stirring at 50 rpm, bringing the temperature down to 25° C. over a period of 3 hours, thereby giving a milky white liquid.

This solution was charged, together with 20 parts by mass of 1 mm glass beads, into a heat-resistant vessel, and dispersion was carried out for 3 hours with a paint shaker (Toyo Seiki). The glass beads were then removed with a nylon mesh, giving Wax Dispersion 1 having a wax content of 20.0 mass %. The wax particles in Wax Dispersion 1 had a volume-average particle diameter of 200 nm.

Preparation Example for Wax Dispersion 2

| | |
|---|---|
| Paraffin wax HNP9 (melting point, 76° C.; Nippon Seiro) | 50.0 parts by mass |
| Wax dispersant (copolymer with peak molecular weight of 8,500 obtained by graft copolymerizing 50.0 parts by mass of styrene, 25.0 parts by mass of n-butyl acrylate and 10.0 parts by mass of acrylonitrile in the presence of 15.0 parts by mass of polyethylene) | 25.0 parts by mass |
| Ethyl acetate | 175.0 parts by mass |

The above components were charged into a glass beaker (Iwaki Glass) equipped with stirring blades, and the wax was dissolved in the ethyl acetate by heating the interior of the system to 80° C. Next, the system interior was gradually cooled under gentle stirring at 50 rpm, bringing the temperature down to 25° C. over a period of 3 hours, thereby giving a milky white liquid.

This solution was charged, together with 20 parts by mass of 1 mm glass beads, into a heat-resistant vessel, and dispersion was carried out for 3 hours with a paint shaker (Toyo Seiki). The glass beads were then removed with a nylon mesh, giving Wax Dispersion 2 having a wax content of 20.0 mass %. The wax particles in Wax Dispersion 2 had a volume-average particle diameter of 200 nm.

Preparation Example for Wax Dispersion 3

| | |
|---|---|
| Paraffin wax HNP9 (melting point, 76° C.; Nippon Seiro) | 50.0 parts by mass |
| Cationic surfactant Neogen RK (Dai-Ichi Kogyo Seiyaku) | 5.0 parts by mass |
| Ion-Exchanged water | 195.0 parts by mass |

The above components were mixed and heated to 95° C., thoroughly dispersed with an Ultra-Turrax T50 (manufactured by IKA), then subjected to dispersion treatment in a pressure discharge-type Gaulin homogenizer, there giving a Wax Dispersion 3 wherein the wax particles had a volume-average particle diameter of 200 nm and the wax content was 20.0 mass %.

Preparation Example for Colorant Dispersion 1

| | |
|---|---|
| C.I. Pigment Blue 15:3 | 100.0 parts by mass |
| Acetone | 150.0 parts by mass |
| Glass beads (1 mm) | 200.0 parts by mass |

The above materials were charged into a heat-resistant glass vessel and dispersion was carried out for 5 hours with a paint shaker, following which the glass beads were removed with a nylon mesh, giving Colorant Dispersion 1 having a solids content of 40.0 mass %. The volume-average particle diameter of colorant particles was 100 nm.

Preparation Example for Colorant Dispersion 2

| | |
|---|---|
| C.I. Pigment Blue 15:3 | 100.0 parts by mass |
| Ethyl acetate | 150.0 parts by mass |
| Glass beads (1 mm) | 200.0 parts by mass |

The above materials were charged into a heat-resistant glass vessel and dispersion was carried out for 5 hours with a paint shaker, following which the glass beads were removed with a nylon mesh, giving Colorant Dispersion 2 having a solids content of 40.0 mass %. The volume-average particle diameter of colorant particles was 100 nm.

Preparation Example for Colorant Dispersion 3>

| | |
|---|---|
| C.I. Pigment Blue 15:3 | 100.0 parts by mass |
| Cationic surfactant (Neogen RK, from Dai-Ichi Kogyo Seiyaku) | 5.0 parts by mass |
| Ion-exchanged water | 145.0 parts by mass |
| Glass beads (1 mm) | 200.0 parts by mass |

The above materials were charged into a heat-resistant glass vessel and dispersion was carried out for 5 hours with a paint shaker, following which the glass beads were removed with a nylon mesh, giving Colorant Dispersion 3 having a solids content of 40.0 mass %. The volume-average particle diameter of colorant particles was 100 nm.

Production Examples for Toner Particle 1

Figure 3:
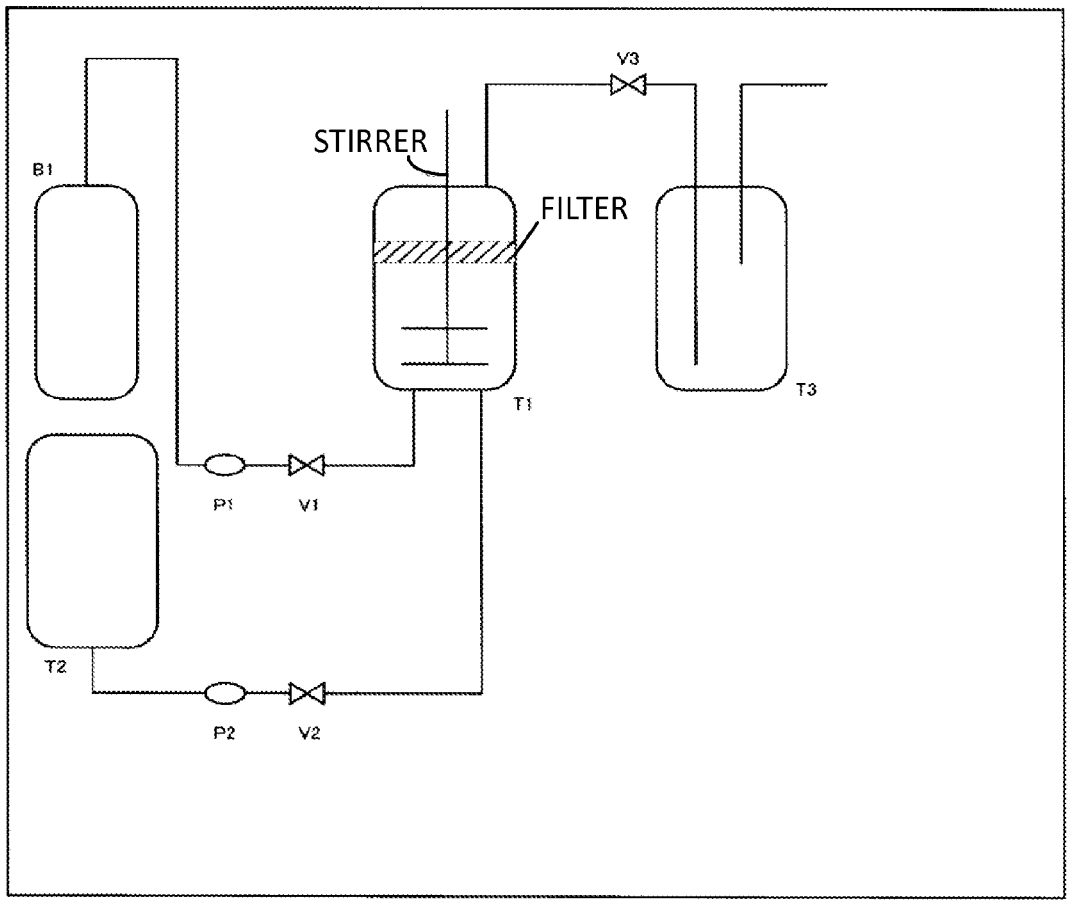
FIG. 3 is a schematic diagram showing a toner manufacturing apparatus.

In the experimental apparatus in FIG. 3, first valves V1 and V2 and pressure regulating valve V3 were closed, 35.0 parts by mass of Shell Resin Dispersion 1 was charged into a pressure-resistant granulation tank T1 equipped with a filter for collecting toner particles and a stirring mechanism, and the internal temperature was adjusted to 30° C. Next, valve V1 was opened and, using pump P1, carbon dioxide (purity, 99.99%) was introduced from cylinder B1 into the pressure-resistant tank T1. When the internal pressure reached 4.0 MPa, the valve V1 was closed.

In a separate procedure, the following components were charged into a resin solution tank T2, and the internal temperature was adjusted to 30° C.

| | |
|---|---|
| Core Resin Solution 1 | 180 parts by mass |
| Wax Dispersion 1 | 25.0 parts by mass |
| Colorant Dispersion 1 | 12.5 parts by mass |
| Acetone | 15.0 parts by mass |

Next, valve V2 was opened and, while stirring the interior of the granulation tank T1 at 2,000 rpm, the contents of the resin solution tank T2 were introduced into the granulation tank T1 with the pump P2. When introduction of all the contents of tank T2 into tank T1 was complete, valve V2 was closed. The internal pressure in the granulation tank T1 following such introduction became 7.0 MPa. The mass of the introduced carbon dioxide was determined by using an equation of state in the literature (*Journal of Physical and Chemi-*

*cal Reference Data*, Vol. 25, pp. 1509-1596) to calculate the carbon dioxide density from the temperature (30° C.) and pressure (7.0 MPa) of the carbon dioxide, and multiplying this density by the volume of the granulation tank T1. The amount of carbon dioxide introduced was 150.0 parts by mass.

After introduction of the resin solution tank T2 contents into the granulation tank T1 was completed, granulation was carried out by stirring at 2,000 rpm for another 3 minutes.

Next, valve V1 was opened and carbon dioxide was introduced from cylinder B1 into the granulation tank T1 using pump P1. At this time, the pressure regulating valve V3 was set to 10.0 MPa and, while holding the internal pressure of the granulation tank T1 at 10.0 MPa, additional carbon dioxide was passed through. By means of this operation, organic solvent (primarily acetone)-containing carbon dioxide extracted from the liquid drops following granulation was discharged into a solvent recovery tank T3, and the organic solvent and carbon dioxide were separated.

Carbon dioxide introduction into the granulation tank T1 was stopped when the amount introduced reached 15 times the mass of carbon dioxide initially introduced into the granulation tank T1. At this point, the operation of replacing the organic solvent-containing carbon dioxide with carbon dioxide containing no organic solvent was completed.

In addition, by opening pressure regulating valve V3 a little at a time and reducing the internal pressure of the granulation tank T1 to atmospheric pressure, Toner Particle 1 collected by the filter was recovered. The resulting Toner Particle 1 had a core-shell structure. The properties of Toner Particle 1 are shown in Table 6.

Production Examples for Toner Particles 2 to 4 and 35 to 37

Aside from changing the type of shell resin dispersion used as shown in Table 6, Toner Particles 2 to 4 and 35 to 37 were obtained in the same way as in the production example for Toner Particle 1. The properties of Toner Particles 2 to 4 and 35 to 37 are shown in Table 6.

Production Example for Toner Particle 5

Preparation of Oil Phase 1

| | |
|---|---|
| Core Resin Solution 2 | 180.0 parts by mass |
| Wax Dispersion 2 | 25.0 parts by mass |
| Colorant Dispersion 2 | 12.5 parts by mass |
| Ethyl acetate | 15.0 parts by mass |

The above materials were placed in a beaker, held at 30° C. and stirred at 6,000 rpm for 3 minutes using a Disper (Tokushu Kika Kogyo), thereby preparing Oil Phase 1.

Preparation of Aqueous Phase 1

| | |
|---|---|
| Shell Resin Dispersion 5 | 35.0 parts by mass |
| Sodium dodecyldiphenyl ether disulfonate, 50% aqueous dispersion (Eleminol MON-7, from Sanyo Chemical Industries) | 30.0 parts by mass |

-continued

| | |
|---|---|
| Carboxymethyl cellulose, 1 mass % aqueous solution | 100.0 parts by mass |
| Propylamine (Kanto Chemical) | 5.0 parts by mass |
| Ion-exchanged water | 400.0 parts by mass |
| Ethyl acetate | 50.0 parts by mass |

The above materials were placed in a vessel and stirred at 5,000 rpm for 1 minute with a TK Homomixer (Tokushu Kikai Kogyo), thereby preparing Aqueous Phase 1.

Granulation Step:

Oil Phase 1 was added to Aqueous Phase 1, the speed of the TK Homomixer was increased to 10,000 rpm and agitation was continued for 1 minute, thereby suspending Oil Phase 1 in Aqueous Phase 1. The suspension was then stirred at 50 rpm for 30 minutes with stirring blades, following which it was transferred to a 2 L pear-shaped flask. Next, using a 25° C. water bath and a rotary evaporator, and while stirring at 30 rpm, nitrogen gas was blown onto the liquid surface at a rate of 10 L/min for 1 hour, thereby giving Toner Particle Dispersion 5.

Washing Step to Drying Step:

Hydrochloric acid was added to Toner Particle Dispersion 5 until the pH became 1.5, then the dispersion was stirred for 30 minutes and subsequently filtered. The operations of filtration and re-dispersion in ion-exchanged water were repeated until the electrical conductivity of the slurry became 100 μS. In this way, the surfactant remaining in the slurry was removed and the propylamine was neutralized and removed, giving a filtration cake of Toner Particle 5. The filtration cake was dried for 3 days at normal temperature in a vacuum dryer, then screened on a mesh with 75-μm openings and pneumatically classified, giving Toner Particle 5. The properties of Toner Particle 5 are shown in Table 6.

Production Examples for Toner Particles 6 to 31 and 33

Aside from changing the type of core resin solution and the type and amount of the shell resin dispersion used as shown in Table 6, Toner Particles 6 to 31 and 33 were obtained in the same way as in the production example for Toner Particle 5. The properties of Toner Particles 6 to 31 and 33 are shown in Table 6.

Toner Particle 32 Production Example

| | |
|---|---|
| Core Resin Solution 7 | 400.0 parts by mass |
| Anionic surfactant (sodium dodecylbenzenesulfonate) | 3.0 parts by mass |
| Ion-exchanged water | 400.0 parts by mass |

The above materials were mixed, heated to 40° C., and agitated at 8,000 rpm for 10 minutes using an emulsifier (Ultra-Turrax T-50, manufactured by IKA), following which the acetone was evaporated, thereby preparing Core Resin Dispersion 7.

| | |
|---|---|
| Core Resin Dispersion 7 | 360.0 parts by mass |
| Colorant Dispersion 3 | 12.5 parts by mass |
| Wax Dispersion 3 | 25.0 parts by mass |
| Aluminum polychloride, 10 mass % aqueous solution | 1.5 parts by mass |

The above components were mixed in a round stainless steel flask, mixed and dispersed in an Ultra-Turrax T50 (IKA), then held at 45° C. for 60 minutes under stirring. Next, 35.0 parts by mass of Shell Resin Dispersion 26 was gradually added and the pH within the system was adjusted to 6 with a 0.5 mol/L aqueous solution of sodium hydroxide. The stainless steel flask was then closed and, using a magnetic seal, was heated to 96° C. under continued stirring. During the period up until the rise in temperature, a suitable amount of the aqueous solution of sodium hydroxide was added so as to keep the pH from falling below 5.5. Thereafter, the system was held at 96° C. for 5 hours.

Following reaction completion, cooling, filtration and thorough washing with ion-exchange water were carried out, after which solid-liquid separation was effected by Buchner-vacuum filtration. The product was re-dispersed in 3 L of ion-exchanged water, and stirred and washed for 15 minutes at 300 rpm. This was repeated another five times and, when the pH of the filtrate had reached 7.0, solid-liquid separation was carried out by Buchner vacuum filtration using No. 5A filter paper. Next, vacuum drying was continued for 12 hours, giving Toner Particles 32. The properties of Toner Particles 32 are shown in Table 6.

Production Example for Toner Particle 34

Preparation of Oil Phase 2

| | |
|---|---|
| Core Resin Solution 5 | 180.0 parts by mass |
| Wax Dispersion 2 | 25.0 parts by mass |
| Colorant Dispersion 2 | 12.5 parts by mass |
| Ethyl acetate | 15.0 parts by mass |

The above materials were placed in a beaker, held at 30° C. and stirred at 6,000 rpm for 3 minutes using a Disper (Tokushu Kika Kogyo), thereby preparing Oil Phase 2.

Preparation of Aqueous Phase 2

| | |
|---|---|
| Hydroxyapatite (5 mass %) | 100.0 parts by mass |
| Sodium dodecyldiphenyl ether disulfonate, 50% aqueous dispersion (Eleminol MON-7, from Sanyo Chemical Industries) | 30.0 parts by mass |
| Carboxymethyl cellulose, 1 mass % aqueous solution | 100.0 parts by mass |
| Ion-exchanged water | 400.0 parts by mass |
| 1-Butanone | 50.0 parts by mass |

The above materials were placed in a vessel and stirred at 5,000 rpm for 1 minute with a TK Homomixer (Tokushu Kikai Kogyo), thereby preparing Aqueous Phase 2.

Granulation Step:

Oil Phase 2 was added to Aqueous Phase 2, the speed of the TK Homomixer was increased to 10,000 rpm and agitation was continued for 1 minute, thereby suspending Oil Phase 2 in Aqueous Phase 2. The suspension was then stirred at 50 rpm for 30 minutes with stirring blades, following which it was transferred to a 2 L pear-shaped flask. Next, using a 25° C. water bath and a rotary evaporator, and while stirring at 30 rpm, nitrogen gas was blown onto the liquid surface at a rate of 10 L/min for 1 hour, thereby giving Toner Particle Dispersion 34.

Washing Step to Drying Step:

Hydrochloric acid was added to Toner Particle Dispersion 34 until the pH became 1.5, then the dispersion was stirred for 30 minutes and subsequently filtered. The operations of filtration and re-dispersion in ion-exchanged water were repeated until the electrical conductivity of the slurry became 100 μS. In this way, the surfactant remaining in the slurry was removed, giving a filtration cake of Toner Particle 34. The filtration cake was dried for 3 days at normal temperature in a vacuum dryer, then screened on a mesh with 75-μm openings and pneumatically classified, giving Toner Particle 34. The properties of Toner Particle 34 are shown in Table 6.

<Production of Carrier Particles>

After adding 4.0 mass % each of a silane coupling agent (3-(2-aminoethylaminopropyl)trimethoxysilane) to magnetite powder having a number-average particle diameter of 0.25 μm and to hematite powder having a number-average particle diameter of 0.60 μm, high-speed mixing and stirring was carried out at a temperature of at least 100° C. within the vessels, thereby lipophilic treating the respective fine powders.

| | |
|---|---|
| Phenol | 10.0 parts by mass |
| Formaldehyde solution (formaldehyde, 40%; methanol, 10%; water, 50%) | 6.0 parts by mass |
| Lipophilic treated magnetite | 63.0 parts by mass |
| Lipophilic treated hematite | 21.0 parts by mass |

The above materials, 5.0 parts by mass of 28% ammonia water and 10.0 parts by mass of water were placed in a flask, the temperature was raised to and held at 85° C. over a period of 30 minutes under stirring and mixing, and a polymerization reaction and curing were effected for 3 hours. Next, the system was cooled to 30° C. and water was again added, following which the supernatant was removed and the precipitate was rinsed with water then air-dried. Next, the precipitate was dried under reduced pressure (5 mmHg or below) at 60° C., giving spherical magnetic resin particles containing the magnetic bodies in a dispersed state.

Next, a copolymer of methyl methacrylate and methyl methacrylate having perfluoroalkyl groups (copolymerization ratio (by mass), 8:1; weight-average molecular weight, 45,000) was used as the coating resin. Then, 10 parts by mass of melamine particles having a number-average particle diameter of 290 nm and 6 parts by mass of carbon particles having a resistivity of $1\times10^{-2}$ Ω·cm and a number-average particle diameter of 30 nm were added to 100 parts by mass of this coating resin, and dispersed for 30 minutes in an ultrasonic disperser. In addition, a methyl ethyl ketone/toluene mixed solvent coating solution was prepared so as to set the coating resin content with respect to the magnetic resin particles to 2.5 parts by mass (solution concentration, 10 mass %).

This coating solution was resin-coated onto the surface of the magnetic resin particles while continuously applying shear stress and evaporating off the solvent at 70° C. The resin-coated magnetic carrier particles were heat-treated at 100° C. while stirring for 2 hours, after which they were cooled and disintegrated, then classified with a 200 mesh screen, thereby giving a carrier having a number-average particle diameter of 33 μm, a true specific gravity of 3.53 g/cm$^3$, an apparent specific gravity of 1.84 g/cm$^3$, and an intensity of magnetization of 42 Am$^2$/kg.

Example 1

Preparation of Toner 1 and Two-component Developer 1

Next, 0.9 parts by mass of anatase-type titanium oxide fine particles (BET specific surface area, 80 $m^2/g$; number-average particle diameter, 15 nm; 12 mass % isobutyl trimethoxysilane-treated) was externally added with a Henschel mixer to 100 parts by mass of above Toner Particle 1, following which 1.2 parts by mass of oil-treated silica fine particles (BET specific surface area, 95 $m^2/g$; 15 mass % silicone oil-treated) and 1.5 parts by mass of sol-gel silica fine particles (BET specific surface area, 24 $m^2/g$; number-average particle diameter, 110 nm) were mixed with a Henschel mixer (FM-10B, from Mitsui Miike Chemical Engineering Machinery, thereby giving Toner 1.

In the invention, two-component Developer 1 obtained by mixing 8.0 parts by mass of Toner 1 and 92.0 parts by mass of the above carrier was prepared. The subsequently described evaluations were each carried out using this Toner 1 or two-component Developer 1. The results of the respective evaluations are shown in Table 8.

Examples 2 to 27, Comparative Examples 1 to 10

Toners 2 to 37 were obtained by carrying out external addition on Toner Particles 2 to 37 in the same way as in Example 1. Next, 8.0 parts by mass of these Toners 2 to 37 and 92.0 parts by mass of the above carrier were mixed, thereby preparing two-component Developers 2 to 37. The subsequently described evaluations were each carried out using these Toners 2 to 37 or two-component Developers 2 to 37. The results of the respective evaluations are shown in Table 8.

<Image Evaluation>

The methods for evaluating the resulting toners or two-component developers are described. A commercially available color copier (manufactured by Canon under the trade name CLC 5000) was used for image evaluation.

<Evaluation of Low-Temperature Fixability>

The above Two-Component Developer 1 and a CLC 5000 (Canon) color laser copier were used for evaluation. The development contrast on the above copier was adjusted so that the toner laid-on level on the paper was 0.6 $mg/cm^2$, and a "solid" unfixed image having an end margin of 5 mm, a width of 100 mm and a length of 280 mm was produced in a normal-temperature, normal-humidity environment (23° C./60% RH). The paper used was A4 paper (Plover Bond Paper, 105 $g/m^2$, available from Fox River).

Next, an LBP 5900 (Canon) fixing unit was modified to enable the fixing temperature to be manually set, and the rotational speed of the fixing unit was changed to 300 mm/s. The pressure during fixing was set to 0.75 $kgf/cm^2$. This modified fixing unit was fixed in a normal-temperature, normal-humidity environment (23° C./60% RH). While raising the fixing temperature at intervals of 5° C. in the range of from 80° C. to 180° C., the above-described "solid" unfixed images were fixed at the respective temperatures, thereby giving fixed images.

A soft thin paper (for example, under the trade name "Dusper" from Ozu Corporation) was covered over the image regions of the resulting fixed images, and a 1.0 kPa load was placed on the paper and rubbed back-and-forth three times over the image region. The image density was measured before rubbing and was measured again after rubbing, and the percent decrease in image density (ΔD (%)) was calculated from the following formula. The temperature when this ratio ΔD (%) was less than 10% was treated as the fixing onset temperature, and the low-temperature fixability was evaluated according to the following criteria.

The image density was measured with a color reflection densitometer (X-Rite 404A, manufactured by X-Rite).

$$\Delta D(\%)=[((\text{image density before rubbing})-(\text{image density after rubbing}))/$$

In this invention, ratings of from A to C were regarded as indicative of a good low-temperature fixability.

<Evaluation Criteria>

A: Fixing onset temperature was less than 100° C.

B: Fixing onset temperature was at least 100° C. but less than 110° C.

C: Fixing onset temperature was at least 110° C. but less than 120° C.

D: Fixing onset temperature was at least 120° C.

<Evaluation of Hot Offset Resistance by Toner>

The fixed images obtained in the above evaluations of fixing onset temperature were evaluated to determine whether hot offset (the phenomenon of a fixed image from the paper adhering to the fixing roller then, with rotation of the fixing roller, re-adhering to the paper) occurs.

Offset was regarded to have occurred when non-image areas had an image density at least 0.05 times the solid image density. The image density was determined using a 500 Series Spectrodensitometer (from X-Rite).

In this invention, ratings of from A to C were regarded as indicative of a good offset resistance.

<Evaluation Criteria>

A: Hot offset arose at 170° C. or above.

B: Hot offset arose at 160° C. or 165° C.

C: Hot offset arose at 150° C. or 155° C.

D: Hot offset arose at 145° C. or below, indicating a poor offset resistance.

<Evaluation of Fixing Temperature Latitude>

Letting the upper limit range at which hot offset does not occur be the temperature at which fixing is possible, the difference between the temperature at which fixing is possible and the fixing onset temperature was treated as the fixing temperature latitude and subjected to evaluation. The evaluation criteria for the fixing temperature latitude are shown below. In this invention, ratings of from A to C were regarded as indicative of a good fixing temperature latitude.

<Evaluation Criteria>

A: Fixing temperature latitude was at least 70° C.

B: Fixing temperature latitude was at least 60° C. but less than 70° C.

C: Fixing temperature latitude was at least 50° C. but less than 60° C.

D: Fixing temperature latitude was less than 50° C.

Evaluation of the toner charging performance was carried out using the percent decrease in the triboelectric charge quantity of the toner after standing in various environments from the initial charge quantity in a N/N (23° C.; 50% RH) environment.

<Evaluation of Initial Charge Quantity of Toner in N/N (23° C., 50% RH) Environment>

Methods for measuring the triboelectric charge quantity of the toner are described below.

First, the toner and the carrier (a standard carrier of The Imaging Society of Japan: N-01, a spherical carrier composed of surface-treated ferrite cores) were placed, in respective amounts of 1.0 g and 19.0 g, in a plastic bottle with a cap and held for 24 hours in a N/N (23° C., 50% RH) environment. The carrier and toner were placed in a plastic bottle with a cap, then the bottle was set in a shaker (YS-LD, manufactured by Yayoi) and shaken for 1 minute at a speed of 4 cycles per second, thereby preparing a developer composed of the toner and the carrier, and at the same time charging the toner.

Figure 4:
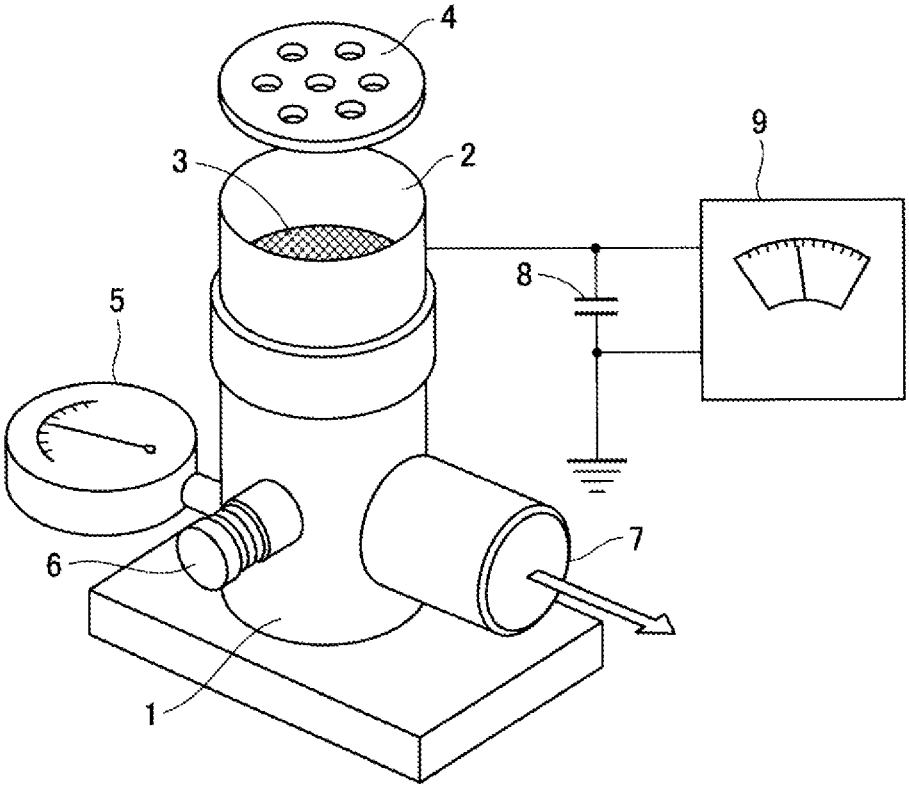
FIG. 4 is a schematic diagram showing an apparatus for measuring the triboelectric charge quantity.

Next, the triboelectric charge quantity was measured using the measuring apparatus shown in FIG. 4. Referring to FIG. 4, about 0.5 to 1.5 g of the above developer was placed in a metal measuring vessel 2 having a 500 mesh screen 3 on the bottom, and a metal cover 4 was placed thereon. The mass of the entire measuring vessel at this time was weighed as W1 (g). Next, in a suction device 1 (at least that portion of which is in contact with the measurement vessel 2 being an insulating body), suction was carried out through a suction port 7, the pressure at a vacuum gauge 5 being set to 2.5 kPa by adjusting an air flow regulating valve 6. Suction was carried out in this state for 2 minutes, thereby aspirating and removing the toner. The potential on an electrometer 9 at this time was set in volts (V). Here, 8 is a capacitor having a capacitance of C (mF). The mass of the entire measuring apparatus following aspiration was weighted as W2 (g).

The triboelectric charge quantity (μC/g) of this sample was computed as follows:

$$\text{Triboelectric charge quantity of sample}(\mu C/g)=C\times V/(W1-W2).$$

In this invention, ratings of from A to C were regarded as indicative of a good charging performance.

<Evaluation Criteria for Initial Charge Quantity>

A: Negative charge quantity was at least 30 μC/g

B: Negative charge quantity was at least 20 μC/g but less than 30 μC/g

C: Negative charge quantity was at least 10 μC/g but less than 20 μC/g

D: Negative charge quantity was less than 10 μC/g

<Evaluation of Percent Decrease in Triboelectric Charge Quantity of Toner After Standing in Various Environments>

The samples for which the initial charge quantities had been measured in the above "Evaluation of Initial Charge Quantity of Toner in N/N (23° C., 50% RH) Environment" were divided into suitable amounts, and left to stand 24 hours in a N/N (23° C., 50% RH) environment and an H/H (30° C., 80% RH) environment. After standing, the charge quantity was measured and the percent decrease in the charge quantity from the initial charge quantity was calculated. The triboelectric charge quantity was measured using the same apparatus and method as in the above-described evaluation of the initial charge quantity.

In this invention, ratings of from A to C were regarded as indicative of a good charging performance.

<Evaluation Criteria for Percent Decrease in Charge Quantity>

A: Decrease in charge quantity was less than 20%

B: Decrease in charge quantity was at least 20% but less than 30%

C: Decrease in charge quantity was at least 30% but less than 40%

D: Decrease in charge quantity was 40% or more

<Evaluation of Heat-Resistant Storage Stability>

About 10 g of toner was placed in a 100 mL plastic cup and left to stand at 53° C. for 3 days, following which each sample was visually evaluated. In this invention, ratings of from A to C were regarded as indicative of a good heat-resistant storage stability.

<Evaluation Criteria>

A: No clumps are observable.

B: Slight clumps are observable.

C: Clumps are observable, but they readily break up.

D: Substantially all of the toner has caked.

TABLE 1

| | Acid ingredients (parts by mass) | | | | Alcohol ingredients (parts by mass) | | Molecular weight | | | DSC |
|---|---|---|---|---|---|---|---|---|---|---|
| | Sebacic acid | Adipic acid | 1,12-Dodecanedi carboxylic acid | 1,16-Hexadecanedi carboxylic acid | 1,4-Butanediol | 1,6-Hexanediol | Number-average molecular weight Mn | Weight-average molecular weight Mw | Mw/Mn | measurement Melting point (° C.) |
| Crystalline Polyester 1 | 111.0 | 20.5 | — | — | 68.5 | — | 2400 | 4400 | 1.8 | 61 |
| Crystalline Polyester 2 | 105.0 | 26.0 | — | — | 69.0 | — | 2300 | 4300 | 1.9 | 56 |
| Crystalline Polyester 3 | — | — | 131.0 | — | — | 69.0 | 2400 | 4400 | 1.8 | 74 |
| Crystalline Polyester 4 | 75.5 | 52.0 | — | — | 72.5 | — | 2400 | 4400 | 1.8 | 50 |
| Crystalline Polyester 5 | — | — | — | 150.0 | 50.0 | — | 2400 | 4400 | 1.8 | 83 |
| Crystalline Polyester 6 | 136.2 | — | — | — | 63.8 | — | 5100 | 11500 | 2.3 | 66 |

TABLE 2

| | Crystalline polyester | | CHDM | XDI | Salicylic acid | Reaction | Re- | | | | | | |
|---|---|---|---|---|---|---|---|---|---|---|---|---|---|
| | Type | Amount parts by mass | Amount parts by mass | Amount parts by mass | Amount parts by mass | tem-perature (° C.) | action time (hr) | Crystalline segment ratio (%) | Mn | Mw | Mw/Mn | Melting point (° C.) | Acid value (mgKOH/g) |
| Block Polymer 1 | Crystalline Polyester 6 | 210.0 | 34.0 | 56.0 | 3.0 | 50 | 15 | 70 | 14600 | 33100 | 2.1 | 58 | 7.1 |
| Block Polymer 2 | Crystalline Polyester 6 | 158.0 | 58.0 | 86.0 | 3.0 | 50 | 15 | 52 | 12500 | 28900 | 2.2 | 58 | 8.8 |
| Block Polymer 3 | Crystalline Polyester 6 | 120.0 | 74.0 | 108.0 | 3.0 | 50 | 15 | 40 | 11400 | 23500 | 2.0 | 58 | 9.5 |
| Block Polymer 4 | Crystalline Polyester 6 | 262.0 | 15.0 | 33.0 | 3.0 | 50 | 16 | 84 | 13700 | 32100 | 2.3 | 58 | 5.1 |

TABLE 3

| | Polyesters | | XDI | 2-HEMA |
|---|---|---|---|---|
| | Type | Amount (parts by mass) | Amount (parts by mass) | Amount (parts by mass) |
| Vinyl Monomer a1 | Crystalline Polyester 1 | 83.0 | 59.0 | 41.0 |
| Vinyl Monomer a2 | Crystalline Polyester 2 | 83.0 | 59.0 | 41.0 |
| Vinyl Monomer a3 | Crystalline Polyester 3 | 83.0 | 59.0 | 41.0 |

TABLE 3-continued

| | Polyesters | | XDI | 2-HEMA |
|---|---|---|---|---|
| | Type | Amount (parts by mass) | Amount (parts by mass) | Amount (parts by mass) |
| Vinyl Monomer a4 | Crystalline Polyester 4 | 83.0 | 59.0 | 41.0 |
| Vinyl Monomer a5 | Crystalline Polyester 5 | 83.0 | 59.0 | 41.0 |

TABLE 4

| | Vinyl Monomer a (parts by mass) | | Vinyl Monomer b | | | | |
|---|---|---|---|---|---|---|---|
| | Type | Amount (parts by mass) | Styrene (parts by mass) | n-Butyl acrylate (parts by mass) | Methyl methacrylate (parts by mass) | Vinyl monomer having organic polysiloxane structure (parts by mass) | 2-Hydroxyethyl methacrylate (parts by mass) |
| Homopolymer Tg | — | | 100° C. | −55° C. | 107° C. | −33° C. | 59° C. |
| Shell Resin Dispersion 1 | Vinyl Monomer a1 | 40.0 | 37.5 | — | — | 15.0 | — |
| Shell Resin Dispersion 2 | Vinyl Monomer a1 | 40.0 | 42.0 | — | — | 15.0 | — |
| Shell Resin Dispersion 3 | Vinyl Monomer a1, Vinyl Monomer a6 | 35.0 15.0 | 42.5 | — | — | — | — |
| Shell Resin Dispersion 4 | Vinyl Monomer a1, Vinyl Monomer a6 | 35.0 15.0 | 47.0 | — | — | — | — |
| Shell Resin Dispersion 5 | Vinyl Monomer a1 | 40.0 | 42.5 | 10.0 | — | — | — |
| Shell Resin Dispersion 6 | Vinyl Monomer a1 | 40.0 | 47.0 | 10.0 | — | — | — |
| Shell Resin Dispersion 7 | Vinyl Monomer a1 | 30.0 | 52.5 | 10.0 | — | — | — |
| Shell Resin Dispersion 8 | Vinyl Monomer a2 | 30.0 | 57.0 | 10.0 | — | — | — |
| Shell Resin Dispersion 9 | Vinyl Monomer a3 | 50.0 | 32.5 | 10.0 | — | — | — |
| Shell Resin Dispersion 10 | Vinyl Monomer a1 | 40.0 | 49.0 | 10.0 | — | — | — |
| Shell Resin Dispersion 11 | Vinyl Monomer a1 | 40.0 | 37.0 | 10.0 | — | — | — |
| Shell Resin Dispersion 12 | Vinyl Monomer a1 | 20.0 | 62.5 | 10.0 | — | — | — |
| Shell Resin Dispersion 13 | Vinyl Monomer a1 | 55.0 | 27.5 | 10.0 | — | — | — |
| Shell Resin Dispersion 14 | Vinyl Monomer a1 | 15.0 | 67.5 | 10.0 | — | — | — |
| Shell Resin Dispersion 15 | Vinyl Monomer a1 | 40.0 | 41.0 | 10.0 | — | — | — |
| Shell Resin Dispersion 16 | Vinyl Monomer a1 | 40.0 | 41.0 | 10.0 | 9.0 | — | — |
| Shell Resin Dispersion 17 | Vinyl Monomer a1 | 40.0 | 41.0 | 10.0 | — | — | — |
| Shell Resin Dispersion 18 | Vinyl Monomer a6 | 50.0 | — | — | 20.0 | — | 22.5 |
| Shell Resin Dispersion 19 | Vinyl Monomer a1 | 10.0 | 72.5 | 10.0 | — | — | — |
| Shell Resin Dispersion 20 | Vinyl Monomer a1 | 60.0 | 22.5 | 10.0 | — | — | — |
| Shell Resin Dispersion 21 | Vinyl Monomer a4 | 40.0 | 42.5 | 10.0 | — | — | — |
| Shell Resin Dispersion 22 | Vinyl Monomer a5 | 40.0 | 42.5 | 10.0 | — | — | — |
| Shell Resin Dispersion 23 | Vinyl Monomer a1 | 50.0 | 43.0 | — | — | 5.0 | — |
| Shell Resin Dispersion 24 | Vinyl Monomer a6 | 55.0 | — | — | — | 25.0 | — |
| Shell Resin Dispersion 25 | Vinyl Monomer a6 | 40.0 | — | 20.0 | — | 20.0 | — |

| | Vinyl Monomer b | | | | Molecular weight | | |
|---|---|---|---|---|---|---|---|
| | Acrylic acid (parts by mass) | 2-Methylstyrene (parts by mass) | Methacrylic acid (parts by mass) | Particle size of fine particles (nm) | Number-average molecular weight Mn | Weight-average molecular weight Mw | Mw/Mn |
| Homopolymer Tg | 111° C. | 127° C. | 170° C. | — | — | — | — |
| Shell Resin Dispersion 1 | — | — | 7.5 | 155 | 14000 | 64000 | 4.6 |
| Shell Resin Dispersion 2 | — | — | 3.0 | 160 | 15000 | 56000 | 3.7 |
| Shell Resin Dispersion 3 | — | — | 7.5 | 155 | 14000 | 63000 | 4.5 |
| Shell Resin Dispersion 4 | — | — | 3.0 | 160 | 15000 | 57000 | 3.8 |
| Shell Resin Dispersion 5 | — | — | 7.5 | 140 | 14000 | 60000 | 4.3 |
| Shell Resin Dispersion 6 | — | — | 3.0 | 145 | 13000 | 55000 | 4.2 |
| Shell Resin Dispersion 7 | — | — | 7.5 | 145 | 12000 | 61000 | 5.1 |
| Shell Resin Dispersion 8 | — | — | 3.0 | 155 | 13000 | 60000 | 4.6 |
| Shell Resin Dispersion 9 | — | — | 7.5 | 160 | 13500 | 60000 | 4.4 |
| Shell Resin Dispersion 10 | — | — | 1.0 | 155 | 14200 | 64000 | 4.5 |
| Shell Resin Dispersion 11 | — | — | 13.0 | 150 | 16100 | 77000 | 4.8 |
| Shell Resin Dispersion 12 | — | — | 7.5 | 180 | 15200 | 60000 | 3.9 |
| Shell Resin Dispersion 13 | — | — | 7.5 | 190 | 14000 | 61000 | 4.4 |
| Shell Resin Dispersion 14 | — | — | 7.5 | 120 | 15200 | 62000 | 4.1 |
| Shell Resin Dispersion 15 | 9.0 | — | — | 155 | 13000 | 61000 | 4.7 |
| Shell Resin Dispersion 16 | — | — | — | 190 | 12000 | 61000 | 5.1 |

TABLE 4-continued

| | | | | | | | |
|---|---|---|---|---|---|---|---|
| Shell Resin Dispersion 17 | — | 9.0 | — | 155 | 11000 | 62000 | 5.6 |
| Shell Resin Dispersion 18 | — | — | 7.5 | 190 | 13000 | 60000 | 4.6 |
| Shell Resin Dispersion 19 | — | — | 7.5 | 170 | 13200 | 55000 | 4.2 |
| Shell Resin Dispersion 20 | — | — | 7.5 | 155 | 11000 | 59000 | 5.4 |
| Shell Resin Dispersion 21 | — | — | 7.5 | 155 | 11000 | 67000 | 6.1 |
| Shell Resin Dispersion 22 | — | — | 7.5 | 160 | 11000 | 58000 | 5.3 |
| Shell Resin Dispersion 23 | — | — | 2.0 | 155 | 19000 | 70000 | 3.7 |
| Shell Resin Dispersion 24 | — | — | 20.0 | 155 | 11200 | 59100 | 5.3 |
| Shell Resin Dispersion 25 | — | — | 20.0 | 160 | 10600 | 67100 | 6.3 |

TABLE 5

| | Resin (1) | Amount (parts by mass) | Resin (2) | Amount (parts by mass) | Solvent (1) | Amount (parts by mass) | Solvent (2) | Amount (parts by mass) | Crystalline structure content in binder resin (mass %) |
|---|---|---|---|---|---|---|---|---|---|
| Core Resin Solution 1 | Block Polymer 1 | 100.0 | — | — | acetone | 100.0 | — | — | 70 |
| Core Resin Solution 2 | Block Polymer 1 | 100.0 | — | — | 2-butanone | 50.0 | ethyl acetate | 50.0 | 70 |
| Core Resin Solution 3 | Block Polymer 2 | 100.0 | — | — | 2-butanone | 50.0 | ethyl acetate | 50.0 | 52 |
| Core Resin Solution 4 | Block Polymer 3 | 100.0 | — | — | 2-butanone | 50.0 | ethyl acetate | 50.0 | 40 |
| Core Resin Solution 5 | Non-Crystalline Polyester 1 | 80.0 | Crystalline Polyester 6 | 20.0 | 2-butanone | 50.0 | ethyl acetate | 50.0 | 20 |
| Core Resin Solution 6 | Non-Crystalline Polyester 1 | 100.0 | — | — | 2-butanone | 50.0 | ethyl acetate | 50.0 | 0 |
| Core Resin Solution 7 | Non-Crystalline Polyester 6 | 100.0 | — | — | acetone | 100.0 | — | — | 100 |
| Core Resin Solution 8 | Non-Crystalline Polyester 1 | 50.0 | Crystalline Polyester 6 | 50.0 | 2-butanone | 50.0 | ethyl acetate | 50.0 | 50 |
| Core Resin Solution 9 | Block Polymer 4 | 100.0 | — | — | 2-butanone | 50.0 | ethyl acetate | 50.0 | 84 |

TABLE 6

| | Core resin solution/dispersion | | Shell resin dispersion | | Colorant dispersion | |
|---|---|---|---|---|---|---|
| | Type | Amount | Type | Amount | Type | Amount |
| Toner Particle 1 | Core Resin Solution 1 | 180.0 | Shell Resin Dispersion 1 | 35.0 | Colorant Dispersion 1 | 12.5 |
| Toner Particle 2 | Core Resin Solution 1 | 180.0 | Shell Resin Dispersion 2 | 35.0 | Colorant Dispersion 1 | 12.5 |
| Toner Particle 3 | Core Resin Solution 1 | 180.0 | Shell Resin Dispersion 3 | 35.0 | Colorant Dispersion 1 | 12.5 |
| Toner Particle 4 | Core Resin Solution 1 | 180.0 | Shell Resin Dispersion 4 | 35.0 | Colorant Dispersion 1 | 12.5 |
| Toner Particle 5 | Core Resin Solution 2 | 180.0 | Shell Resin Dispersion 5 | 35.0 | Colorant Dispersion 2 | 12.5 |
| Toner Particle 6 | Core Resin Solution 2 | 180.0 | Shell Resin Dispersion 6 | 35.0 | Colorant Dispersion 2 | 12.5 |
| Toner Particle 7 | Core Resin Solution 2 | 180.0 | Shell Resin Dispersion 7 | 35.0 | Colorant Dispersion 2 | 12.5 |
| Toner Particle 8 | Core Resin Solution 2 | 180.0 | Shell Resin Dispersion 8 | 35.0 | Colorant Dispersion 2 | 12.5 |
| Toner Particle 9 | Core Resin Solution 2 | 180.0 | Shell Resin Dispersion 9 | 35.0 | Colorant Dispersion 2 | 12.5 |
| Toner Particle 10 | Core Resin Solution 3 | 180.0 | Shell Resin Dispersion 5 | 35.0 | Colorant Dispersion 2 | 12.5 |
| Toner Particle 11 | Core Resin Solution 4 | 180.0 | Shell Resin Dispersion 5 | 35.0 | Colorant Dispersion 2 | 12.5 |
| Toner Particle 12 | Core Resin Solution 5 | 180.0 | Shell Resin Dispersion 5 | 35.0 | Colorant Dispersion 2 | 12.5 |
| Toner Particle 13 | Core Resin Solution 6 | 180.0 | Shell Resin Dispersion 5 | 35.0 | Colorant Dispersion 2 | 12.5 |
| Toner Particle 14 | Core Resin Solution 2 | 180.0 | Shell Resin Dispersion 5 | 75.0 | Colorant Dispersion 2 | 12.5 |
| Toner Particle 15 | Core Resin Solution 2 | 180.0 | Shell Resin Dispersion 5 | 15.0 | Colorant Dispersion 2 | 12.5 |
| Toner Particle 16 | Core Resin Solution 2 | 180.0 | Shell Resin Dispersion 5 | 80.0 | Colorant Dispersion 2 | 12.5 |
| Toner Particle 17 | Core Resin Solution 2 | 180.0 | Shell Resin Dispersion 5 | 12.5 | Colorant Dispersion 2 | 12.5 |
| Toner Particle 18 | Core Resin Solution 2 | 180.0 | Shell Resin Dispersion 10 | 35.0 | Colorant Dispersion 2 | 12.5 |
| Toner Particle 19 | Core Resin Solution 2 | 180.0 | Shell Resin Dispersion 11 | 35.0 | Colorant Dispersion 2 | 12.5 |
| Toner Particle 20 | Core Resin Solution 2 | 180.0 | Shell Resin Dispersion 12 | 35.0 | Colorant Dispersion 2 | 12.5 |
| Toner Particle 21 | Core Resin Solution 2 | 180.0 | Shell Resin Dispersion 13 | 35.0 | Colorant Dispersion 2 | 12.5 |
| Toner Particle 22 | Core Resin Solution 2 | 180.0 | Shell Resin Dispersion 14 | 35.0 | Colorant Dispersion 2 | 12.5 |
| Toner Particle 23 | Core Resin Solution 2 | 180.0 | Shell Resin Dispersion 15 | 35.0 | Colorant Dispersion 2 | 12.5 |
| Toner Particle 24 | Core Resin Solution 2 | 180.0 | Shell Resin Dispersion 16 | 35.0 | Colorant Dispersion 2 | 12.5 |
| Toner Particle 25 | Core Resin Solution 2 | 180.0 | Shell Resin Dispersion 17 | 35.0 | Colorant Dispersion 2 | 12.5 |
| Toner Particle 26 | Core Resin Solution 2 | 180.0 | Shell Resin Dispersion 18 | 35.0 | Colorant Dispersion 2 | 12.5 |
| Toner Particle 27 | Core Resin Solution 9 | 180.0 | Shell Resin Dispersion 5 | 35.0 | Colorant Dispersion 2 | 12.5 |
| Toner Particle 28 | Core Resin Solution 2 | 180.0 | Shell Resin Dispersion 19 | 35.0 | Colorant Dispersion 2 | 12.5 |
| Toner Particle 29 | Core Resin Solution 2 | 180.0 | Shell Resin Dispersion 20 | 35.0 | Colorant Dispersion 2 | 12.5 |
| Toner Particle 30 | Core Resin Solution 2 | 180.0 | Shell Resin Dispersion 21 | 35.0 | Colorant Dispersion 2 | 12.5 |
| Toner Particle 31 | Core Resin Solution 2 | 180.0 | Shell Resin Dispersion 22 | 35.0 | Colorant Dispersion 2 | 12.5 |
| Toner Particle 32 | Core Resin Dispersion 7 | 360.0 | Shell Resin Dispersion 26 | 35.0 | Colorant Dispersion 3 | 12.5 |
| Toner Particle 33 | Core Resin Solution 8 | 180.0 | Shell Resin Dispersion 26 | 35.0 | Colorant Dispersion 2 | 12.5 |
| Toner Particle 34 | Core Resin Solution 5 | 180.0 | — | — | Colorant Dispersion 2 | 12.5 |
| Toner Particle 35 | Core Resin Solution 1 | 180.0 | Shell Resin Dispersion 23 | 35.0 | Colorant Dispersion 1 | 12.5 |
| Toner Particle 36 | Core Resin Solution 1 | 180.0 | Shell Resin Dispersion 24 | 35.0 | Colorant Dispersion 1 | 12.5 |
| Toner Particle 37 | Core Resin Solution 1 | 180.0 | Shell Resin Dispersion 25 | 35.0 | Colorant Dispersion 1 | 12.5 |

TABLE 6-continued

| | Wax dispersion | | Particle diameter | | | Molecular weight | | |
|---|---|---|---|---|---|---|---|---|
| | Type | Amount | D4 | D1 | D4/D1 | Mn | Mw | Mw/Mn |
| Toner Particle 1 | Wax Dispersion 1 | 25.0 | 6.6 | 5.8 | 1.14 | 15000 | 34000 | 2.27 |
| Toner Particle 2 | Wax Dispersion 1 | 25.0 | 6.5 | 5.9 | 1.10 | 15200 | 34400 | 2.26 |
| Toner Particle 3 | Wax Dispersion 1 | 25.0 | 6.4 | 5.8 | 1.10 | 15000 | 34200 | 2.28 |
| Toner Particle 4 | Wax Dispersion 1 | 25.0 | 6.3 | 5.7 | 1.11 | 15200 | 34600 | 2.28 |
| Toner Particle 5 | Wax Dispersion 2 | 25.0 | 6.5 | 5.9 | 1.10 | 15800 | 37000 | 2.34 |
| Toner Particle 6 | Wax Dispersion 2 | 25.0 | 6.2 | 5.9 | 1.05 | 15000 | 35100 | 2.34 |
| Toner Particle 7 | Wax Dispersion 2 | 25.0 | 6.5 | 6.1 | 1.07 | 15100 | 35500 | 2.35 |
| Toner Particle 8 | Wax Dispersion 2 | 25.0 | 6.5 | 5.3 | 1.23 | 15200 | 36000 | 2.37 |
| Toner Particle 9 | Wax Dispersion 2 | 25.0 | 6.7 | 5.7 | 1.18 | 14700 | 37500 | 2.55 |
| Toner Particle 10 | Wax Dispersion 2 | 25.0 | 6.5 | 5.8 | 1.12 | 12700 | 29000 | 2.28 |
| Toner Particle 11 | Wax Dispersion 2 | 25.0 | 6.2 | 5.6 | 1.11 | 11500 | 26700 | 2.32 |
| Toner Particle 12 | Wax Dispersion 2 | 25.0 | 6.5 | 5.9 | 1.10 | 8500 | 43200 | 5.08 |
| Toner Particle 13 | Wax Dispersion 2 | 25.0 | 6.4 | 5.9 | 1.08 | 7500 | 42000 | 5.60 |
| Toner Particle 14 | Wax Dispersion 2 | 25.0 | 7.0 | 5.5 | 1.27 | 15300 | 34100 | 2.23 |
| Toner Particle 15 | Wax Dispersion 2 | 25.0 | 6.5 | 5.1 | 1.27 | 15500 | 34500 | 2.23 |
| Toner Particle 16 | Wax Dispersion 2 | 25.0 | 7.2 | 5.5 | 1.31 | 15200 | 35500 | 2.34 |
| Toner Particle 17 | Wax Dispersion 2 | 25.0 | 6.7 | 4.9 | 1.37 | 14700 | 38000 | 2.59 |
| Toner Particle 18 | Wax Dispersion 2 | 25.0 | 6.5 | 5.6 | 1.16 | 14200 | 42000 | 2.96 |
| Toner Particle 19 | Wax Dispersion 2 | 25.0 | 6.3 | 5.2 | 1.21 | 13800 | 45000 | 3.26 |
| Toner Particle 20 | Wax Dispersion 2 | 25.0 | 6.2 | 5.2 | 1.19 | 14000 | 42500 | 3.04 |
| Toner Particle 21 | Wax Dispersion 2 | 25.0 | 6.5 | 5.4 | 1.20 | 14200 | 43000 | 3.03 |
| Toner Particle 22 | Wax Dispersion 2 | 25.0 | 6.5 | 5.5 | 1.18 | 14300 | 43200 | 3.02 |
| Toner Particle 23 | Wax Dispersion 2 | 25.0 | 6.6 | 5.2 | 1.27 | 13800 | 45000 | 3.26 |
| Toner Particle 24 | Wax Dispersion 2 | 25.0 | 6.4 | 5.6 | 1.14 | 14400 | 47000 | 3.26 |
| Toner Particle 25 | Wax Dispersion 2 | 25.0 | 6.5 | 5.5 | 1.18 | 15100 | 46000 | 3.05 |
| Toner Particle 26 | Wax Dispersion 2 | 25.0 | 6.5 | 5.9 | 1.10 | 13900 | 45000 | 3.24 |
| Toner Particle 27 | Wax Dispersion 2 | 25.0 | 6.5 | 5.1 | 1.27 | 13700 | 34100 | 2.49 |
| Toner Particle 28 | Wax Dispersion 2 | 25.0 | 6.7 | 5.5 | 1.22 | 14200 | 43000 | 3.03 |
| Toner Particle 29 | Wax Dispersion 2 | 25.0 | 6.6 | 5.6 | 1.18 | 14300 | 41000 | 2.87 |
| Toner Particle 30 | Wax Dispersion 2 | 25.0 | 6.5 | 5.6 | 1.16 | 14400 | 48000 | 3.33 |
| Toner Particle 31 | Wax Dispersion 2 | 25.0 | 6.4 | 5.5 | 1.16 | 15100 | 52000 | 3.44 |
| Toner Particle 32 | Wax Dispersion 3 | 25.0 | 6.5 | 5.5 | 1.18 | 15500 | 55000 | 3.55 |
| Toner Particle 33 | Wax Dispersion 2 | 25.0 | 6.4 | 5.6 | 1.14 | 6000 | 42000 | 7.00 |
| Toner Particle 34 | Wax Dispersion 2 | 25.0 | 8.1 | 5.7 | 1.42 | 8500 | 43200 | 5.08 |
| Toner Particle 35 | Wax Dispersion 1 | 25.0 | 6.6 | 5.4 | 1.22 | 15100 | 51000 | 3.38 |
| Toner Particle 36 | Wax Dispersion 1 | 25.0 | 6.5 | 5.6 | 1.16 | 14600 | 42000 | 2.88 |
| Toner Particle 37 | Wax Dispersion 1 | 25.0 | 6.5 | 5.3 | 1.23 | 15000 | 43000 | 2.87 |

Note: Toner Particles 1 to 33, 35 and 37 are all particles having a core-shell structure.

TABLE 7

| | Shell resin | Core resin | Peak temperature TpA (° C.) of highest endothermic peak | Loss elastic modulus G"a(TpA − 10) | G"a(TpA) [Pa] | G"a(TpA + 10) [Pa] | G"a(TpA + 25) [Pa] | G"b(TpA + 10) [Pa] |
|---|---|---|---|---|---|---|---|---|
| Toner Particle 1 | Shell Resin A1 | Core Resin 1 | 61 | $7.9 \times 10^7$ | $1.6 \times 10^7$ | $3.2 \times 10^5$ | $7.9 \times 10^4$ | $5.0 \times 10^5$ |
| Toner Particle 2 | Shell Resin A2 | Core Resin 1 | 61 | $4.0 \times 10^7$ | $7.9 \times 10^6$ | $2.5 \times 10^4$ | $1.6 \times 10^4$ | $3.2 \times 10^5$ |
| Toner Particle 3 | Shell Resin A3 | Core Resin 1 | 61 | $7.9 \times 10^7$ | $1.6 \times 10^7$ | $3.2 \times 10^5$ | $7.9 \times 10^4$ | $5.0 \times 10^5$ |
| Toner Particle 4 | Shell Resin A4 | Core Resin 1 | 61 | $4.0 \times 10^7$ | $7.9 \times 10^6$ | $2.5 \times 10^4$ | $1.6 \times 10^4$ | $3.2 \times 10^5$ |
| Toner Particle 5 | Shell Resin A5 | Core Resin 2 | 61 | $7.9 \times 10^7$ | $1.3 \times 10^7$ | $2.5 \times 10^5$ | $1.0 \times 10^5$ | $3.2 \times 10^5$ |
| Toner Particle 6 | Shell Resin A6 | Core Resin 2 | 61 | $4.0 \times 10^7$ | $6.3 \times 10^6$ | $5.0 \times 10^4$ | $3.2 \times 10^4$ | $3.2 \times 10^5$ |
| Toner Particle 7 | Shell Resin A7 | Core Resin 2 | 61 | $6.3 \times 10^7$ | $2.0 \times 10^7$ | $1.3 \times 10^6$ | $2.0 \times 10^5$ | $3.2 \times 10^5$ |
| Toner Particle 8 | Shell Resin A8 | Core Resin 2 | 56 | $3.2 \times 10^7$ | $1.3 \times 10^7$ | $3.2 \times 10^5$ | $6.3 \times 10^4$ | $5.0 \times 10^5$ |
| Toner Particle 9 | Shell Resin A9 | Core Resin 2 | 74 | $3.2 \times 10^7$ | $2.0 \times 10^7$ | $1.6 \times 10^5$ | $7.9 \times 10^4$ | $3.2 \times 10^4$ |
| Toner Particle 10 | Shell Resin A5 | Core Resin 3 | 61 | $3.2 \times 10^7$ | $1.3 \times 10^7$ | $2.5 \times 10^5$ | $1.0 \times 10^5$ | $1.0 \times 10^6$ |
| Toner Particle 11 | Shell Resin A5 | Core Resin 4 | 61 | $7.9 \times 10^7$ | $1.3 \times 10^7$ | $2.5 \times 10^5$ | $1.0 \times 10^5$ | $1.6 \times 10^6$ |
| Toner Particle 12 | Shell Resin A5 | Core Resin 5 | 61 | $7.9 \times 10^7$ | $1.3 \times 10^7$ | $2.5 \times 10^5$ | $1.0 \times 10^5$ | $5.0 \times 10^6$ |
| Toner Particle 13 | Shell Resin A5 | Core Resin 6 | 61 | $7.9 \times 10^7$ | $1.3 \times 10^7$ | $2.5 \times 10^5$ | $1.0 \times 10^5$ | $7.9 \times 10^6$ |
| Toner Particle 14 | Shell Resin A5 | Core Resin 2 | 61 | $3.2 \times 10^7$ | $1.3 \times 10^7$ | $2.5 \times 10^5$ | $1.0 \times 10^5$ | $3.2 \times 10^5$ |
| Toner Particle 15 | Shell Resin A5 | Core Resin 2 | 61 | $3.2 \times 10^7$ | $1.3 \times 10^7$ | $2.5 \times 10^5$ | $1.0 \times 10^5$ | $3.2 \times 10^5$ |
| Toner Particle 16 | Shell Resin A5 | Core Resin 2 | 61 | $3.2 \times 10^7$ | $1.3 \times 10^7$ | $2.5 \times 10^5$ | $1.0 \times 10^5$ | $3.2 \times 10^5$ |
| Toner Particle 17 | Shell Resin A5 | Core Resin 2 | 61 | $3.2 \times 10^7$ | $1.3 \times 10^7$ | $2.5 \times 10^5$ | $1.0 \times 10^5$ | $3.2 \times 10^5$ |
| Toner Particle 18 | Shell Resin A10 | Core Resin 2 | 61 | $3.2 \times 10^7$ | $1.3 \times 10^7$ | $1.0 \times 10^5$ | $3.2 \times 10^4$ | $3.2 \times 10^5$ |
| Toner Particle 19 | Shell Resin A11 | Core Resin 2 | 61 | $7.9 \times 10^7$ | $6.3 \times 10^7$ | $2.0 \times 10^6$ | $2.5 \times 10^5$ | $3.2 \times 10^5$ |
| Toner Particle 20 | Shell Resin A12 | Core Resin 2 | 61 | $7.9 \times 10^7$ | $1.6 \times 10^7$ | $1.3 \times 10^6$ | $1.6 \times 10^5$ | $3.2 \times 10^5$ |
| Toner Particle 21 | Shell Resin A13 | Core Resin 2 | 61 | $1.0 \times 10^8$ | $1.3 \times 10^7$ | $1.0 \times 10^4$ | $7.9 \times 10^3$ | $3.2 \times 10^5$ |
| Toner Particle 22 | Shell Resin A14 | Core Resin 2 | 61 | $3.2 \times 10^7$ | $1.6 \times 10^7$ | $1.6 \times 10^6$ | $2.0 \times 10^5$ | $3.2 \times 10^5$ |
| Toner Particle 23 | Shell Resin A15 | Core Resin 2 | 61 | $3.2 \times 10^7$ | $1.6 \times 10^7$ | $2.0 \times 10^4$ | $1.3 \times 10^4$ | $3.2 \times 10^5$ |
| Toner Particle 24 | Shell Resin A16 | Core Resin 2 | 61 | $3.2 \times 10^7$ | $1.6 \times 10^7$ | $3.2 \times 10^4$ | $1.3 \times 10^4$ | $3.2 \times 10^5$ |

TABLE 7-continued

| | | | | | | | | |
|---|---|---|---|---|---|---|---|---|
| Toner Particle 25 | Shell Resin A17 | Core Resin 2 | 61 | $3.2 \times 10^7$ | $1.6 \times 10^7$ | $4.0 \times 10^4$ | $2.5 \times 10^4$ | $3.2 \times 10^5$ |
| Toner Particle 26 | Shell Resin A18 | Core Resin 2 | 63 | $1.3 \times 10^7$ | $2.0 \times 10^6$ | $5.0 \times 10^4$ | $1.3 \times 10^4$ | $3.2 \times 10^5$ |
| Toner Particle 27 | Shell Resin A5 | Core Resin 9 | 61 | $7.9 \times 10^7$ | $1.3 \times 10^7$ | $2.5 \times 10^5$ | $1.0 \times 10^5$ | $1.0 \times 10^5$ |
| Toner Particle 28 | Shell Resin A19 | Core Resin 2 | 61 | $3.2 \times 10^7$ | $1.6 \times 10^7$ | $2.0 \times 10^6$ | $1.0 \times 10^5$ | $3.2 \times 10^5$ |
| Toner Particle 29 | Shell Resin A20 | Core Resin 2 | 61 | $3.2 \times 10^7$ | $1.6 \times 10^7$ | $1.0 \times 10^3$ | $7.9 \times 10$ | $3.2 \times 10^5$ |
| Toner Particle 30 | Shell Resin A21 | Core Resin 2 | 50 | $7.9 \times 10^7$ | $1.3 \times 10^7$ | $4.0 \times 10^5$ | $1.0 \times 10^5$ | $5.0 \times 10^6$ |
| Toner Particle 31 | Shell Resin A22 | Core Resin 2 | 83 | $7.9 \times 10^7$ | $1.3 \times 10^7$ | $4.0 \times 10^5$ | $1.0 \times 10^5$ | $1.0 \times 10^3$ |
| Toner Particle 32 | Shell Resin A26 | Core Resin 7 | 63(Tg) | $1.6 \times 10^8$ | $7.9 \times 10^7$ | $2.5 \times 10^6$ | $4.0 \times 10^5$ | $3.2 \times 10^5$ |
| Toner Particle 33 | Shell Resin A26 | Core Resin 8 | 63(Tg) | $1.6 \times 10^8$ | $7.9 \times 10^7$ | $2.5 \times 10^6$ | $2.0 \times 10^5$ | $3.2 \times 10^5$ |
| Toner Particle 34 | — | Core Resin 5 | | | | | | $3.2 \times 10^5$ |
| Toner Particle 35 | Shell Resin A23 | Core Resin 1 | 61 | $1.0 \times 10^8$ | $6.3 \times 10^7$ | $5.0 \times 10^3$ | $2.0 \times 10^3$ | $3.2 \times 10^5$ |
| Toner Particle 36 | Shell Resin A24 | Core Resin 1 | 63 | $1.3 \times 10^7$ | $7.9 \times 10^6$ | $1.0 \times 10^6$ | $3.2 \times 10^5$ | $3.2 \times 10^5$ |
| Toner Particle 37 | Shell Resin A25 | Core Resin 1 | 63 | $1.3 \times 10^7$ | $7.9 \times 10^6$ | $1.3 \times 10^6$ | $4.0 \times 10^5$ | $3.2 \times 10^5$ |

| | G"b(TpA + 25) [Pa] | Formula (1) log(G"a(TpA)) − log(G"a(TpA + 10)) | Formula (2) log(G"a(TpA + 10)) − log(G"a(TpA + 25)) | Formula (3) log(G"a(TpA + 10)) − log(G"b(TpA + 10)) | Formula (4) G"a(TpA + 25) − G"b(TpA + 25) |
|---|---|---|---|---|---|
| Toner Particle 1 | $7.0 \times 10^3$ | 1.7 | 0.6 | −0.2 | + |
| Toner Particle 2 | $7.0 \times 10^3$ | 2.5 | 0.2 | −1.1 | + |
| Toner Particle 3 | $7.0 \times 10^3$ | 1.7 | 0.6 | −0.2 | + |
| Toner Particle 4 | $7.0 \times 10^3$ | 2.5 | 0.2 | −1.1 | + |
| Toner Particle 5 | $7.0 \times 10^3$ | 1.7 | 0.4 | −0.1 | + |
| Toner Particle 6 | $7.0 \times 10^3$ | 2.1 | 0.2 | −0.8 | + |
| Toner Particle 7 | $7.0 \times 10^3$ | 1.2 | 0.8 | 0.6 | + |
| Toner Particle 8 | $1.0 \times 10^4$ | 1.6 | 0.7 | −0.2 | + |
| Toner Particle 9 | $1.0 \times 10^2$ | 2.1 | 0.3 | 0.7 | + |
| Toner Particle 10 | $3.0 \times 10^4$ | 1.7 | 0.4 | −0.6 | + |
| Toner Particle 11 | $6.0 \times 10^4$ | 1.7 | 0.4 | −0.8 | + |
| Toner Particle 12 | $8.0 \times 10^4$ | 1.7 | 0.4 | −1.3 | + |
| Toner Particle 13 | $3.0 \times 10^4$ | 1.7 | 0.4 | −1.5 | + |
| Toner Particle 14 | $7.0 \times 10^3$ | 1.7 | 0.4 | −0.1 | + |
| Toner Particle 15 | $7.0 \times 10^3$ | 1.7 | 0.4 | −0.1 | + |
| Toner Particle 16 | $7.0 \times 10^3$ | 1.7 | 0.4 | −0.1 | + |
| Toner Particle 17 | $7.0 \times 10^3$ | 1.7 | 0.4 | −0.1 | + |
| Toner Particle 18 | $7.0 \times 10^3$ | 2.1 | 0.5 | −0.5 | + |
| Toner Particle 19 | $7.0 \times 10^3$ | 1.5 | 0.9 | 0.8 | + |
| Toner Particle 20 | $7.0 \times 10^3$ | 1.1 | 0.9 | 0.6 | + |
| Toner Particle 21 | $7.0 \times 10^3$ | 3.1 | 0.1 | −1.5 | + |
| Toner Particle 22 | $7.0 \times 10^3$ | 1.0 | 0.9 | 0.7 | + |
| Toner Particle 23 | $7.0 \times 10^3$ | 2.9 | 0.2 | −1.2 | + |
| Toner Particle 24 | $7.0 \times 10^3$ | 2.7 | 0.4 | −1.0 | + |
| Toner Particle 25 | $7.0 \times 10^3$ | 2.6 | 0.2 | −0.9 | + |
| Toner Particle 26 | $7.0 \times 10^2$ | 1.6 | 0.6 | −0.8 | + |
| Toner Particle 27 | $5.0 \times 10^2$ | 1.7 | 0.4 | 0.4 | + |
| Toner Particle 28 | $7.0 \times 10^3$ | 0.9 | 1.3 | 0.8 | + |
| Toner Particle 29 | $7.0 \times 10^3$ | 4.2 | 1.1 | −2.5 | − |
| Toner Particle 30 | $9.0 \times 10^3$ | 1.5 | 0.6 | −1.1 | + |
| Toner Particle 31 | $1.0 \times 10^2$ | 1.5 | 0.6 | 2.6 | + |
| Toner Particle 32 | $1.0 \times 10^2$ | 1.5 | 0.8 | 0.9 | + |
| Toner Particle 33 | $5.0 \times 10^4$ | 1.5 | 1.1 | 0.9 | + |
| Toner Particle 34 | $6.0 \times 10^4$ | | | | − |
| Toner Particle 35 | $7.0 \times 10^3$ | 4.1 | 0.4 | −1.8 | − |
| Toner Particle 36 | $7.0 \times 10^2$ | 0.9 | 0.5 | 0.5 | + |
| Toner Particle 37 | $7.0 \times 10^2$ | 0.8 | 0.5 | 0.6 | + |

TABLE 8

| | Toner particle | Toner | Low-temperature fixability (temperature is shown in bracket) | Hot offset resistance (temperature is shown in bracket) | Fixing temperature latitude (temperature is shown in bracket) | Heat-resistant storage stability When held 3 days at 53° C. | Charging performance % Decrease (NN, 24-hour) | % Decrease (HH, 24-hour) | NN initial charge quantity (−μC/g) |
|---|---|---|---|---|---|---|---|---|---|
| Example 1 | Toner Particle 1 | Toner 1 | A(90) | A(170) | A(80) | A | A | A | 35 |
| Example 2 | Toner Particle 2 | Toner 2 | A(90) | B(160) | A(80) | B | A | B | 25 |
| Example 3 | Toner Particle 3 | Toner 3 | A(90) | A(170) | A(80) | B | A | A | 35 |
| Example 4 | Toner Particle 4 | Toner 4 | A(90) | B(160) | A(70) | B | A | B | 25 |
| Example 5 | Toner Particle 5 | Toner 5 | A(90) | A(170) | A(80) | B | A | A | 35 |
| Example 6 | Toner Particle 6 | Toner 6 | A(95) | B(160) | B(65) | B | A | B | 25 |
| Example 7 | Toner Particle 7 | Toner 7 | B(100) | B(160) | B(60) | A | A | A | 32 |
| Example 8 | Toner Particle 8 | Toner 8 | A(90) | B(160) | A(70) | A | A | A | 35 |
| Example 9 | Toner Particle 9 | Toner 9 | C(115) | A(175) | B(60) | A | B | B | 25 |
| Example 10 | Toner Particle 10 | Toner 10 | A(95) | A(170) | A(75) | B | A | A | 35 |
| Example 11 | Toner Particle 11 | Toner 11 | B(105) | A(170) | B(65) | B | A | A | 35 |

TABLE 8-continued

| | Toner particle | Toner | Low-temperature fixability (temperature is shown in bracket) | Hot offset resistance (temperature is shown in bracket) | Fixing temperature latitude (temperature is shown in bracket) | Heat-resistant storage stability When held 3 days at 53° C. | Charging performance % Decrease (NN, 24-hour) | % Decrease (HH, 24-hour) | NN initial charge quantity (−μC/g) |
|---|---|---|---|---|---|---|---|---|---|
| Example 12 | Toner Particle 12 | Toner 12 | C(110) | A(170) | B(60) | B | A | A | 35 |
| Example 13 | Toner Particle 13 | Toner 13 | C(115) | A(170) | C(55) | B | A | A | 35 |
| Example 14 | Toner Particle 14 | Toner 14 | B(105) | A(170) | B(65) | A | B | B | 37 |
| Example 15 | Toner Particle 15 | Toner 15 | A(90) | B(160) | A(70) | B | A | B | 25 |
| Example 16 | Toner Particle 16 | Toner 16 | C(115) | A(170) | C(55) | A | B | C | 38 |
| Example 17 | Toner Particle 17 | Toner 17 | A(90) | C(150) | B(60) | C | A | B | 21 |
| Example 18 | Toner Particle 18 | Toner 18 | A(90) | C(150) | B(60) | C | A | A | 12 |
| Example 19 | Toner Particle 19 | Toner 19 | C(115) | A(175) | B(60) | A | A | B | 32 |
| Example 20 | Toner Particle 20 | Toner 20 | C(115) | A(170) | B(60) | A | A | A | 35 |
| Example 21 | Toner Particle 21 | Toner 21 | A(90) | C(150) | B(60) | A | C | C | 25 |
| Example 22 | Toner Particle 22 | Toner 22 | C(115) | A(175) | B(60) | A | A | A | 35 |
| Example 23 | Toner Particle 23 | Toner 23 | B(105) | A(170) | B(65) | A | A | A | 35 |
| Example 24 | Toner Particle 24 | Toner 24 | B(105) | A(170) | B(65) | A | A | B | 12 |
| Example 25 | Toner Particle 25 | Toner 25 | B(105) | A(170) | B(65) | A | A | B | 12 |
| Example 26 | Toner Particle 26 | Toner 26 | B(105) | C(150) | C(45) | B | B | C | 15 |
| Example 27 | Toner Particle 27 | Toner 27 | A(90) | C(150) | B(60) | B | A | A | 35 |
| Comparative Example 1 | Toner Particle 28 | Toner 28 | D(120) | A(170) | C(50) | A | A | A | 35 |
| Comparative Example 2 | Toner Particle 29 | Toner 29 | A(90) | D(140) | C(50) | A | C | D | 20 |
| Comparative Example 3 | Toner Particle 30 | Toner 30 | A(90) | D(145) | C(55) | D | A | A | 35 |
| Comparative Example 4 | Toner Particle 31 | Toner 31 | D(135) | A(180) | D(45) | A | A | A | 35 |
| Comparative Example 5 | Toner Particle 32 | Toner 32 | C(115) | B(160) | D(45) | C | B | C | 8 |
| Comparative Example 6 | Toner Particle 33 | Toner 33 | C(115) | D(130) | D(15) | C | B | B | 25 |
| Comparative Example 7 | Toner Particle 34 | Toner 34 | D(120) | B(160) | D(40) | D | B | B | 25 |
| Comparative Example 8 | Toner Particle 35 | Toner 35 | B(100) | D(145) | D(45) | C | A | A | 12 |
| Comparative Example 9 | Toner Particle 36 | Toner 36 | D(120) | B(165) | D(45) | B | B | C | 15 |
| Comparative Example 10 | Toner Particle 37 | Toner 37 | D(120) | A(170) | D(45) | B | B | C | 15 |

REFERENCE SIGNS LIST

1: Suction device (at least that portion in contact with measurement vessel 2 is an insulating body), 2: Metal measurement vessel, 3: 500-mesh screen, 4: Metal cover, 5: Vacuum gauge, 6: Air flow adjusting valve, 7: Suction port, 8: Capacitor, 9: Electrometer, T1: Granulating tank, T2: Resin solution tank, T3: Solvent recovery tank, B1: Carbon dioxide cylinder, P1, P2: Pumps, V1, V2, V3: Pressure regulating valves While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-125764, filed on Jun. 3, 2011, which is hereby incorporated by reference herein in its entirety.

What is claimed is:

1. A toner comprising toner particles, wherein:

each of the toner particles comprises a core-shell structure composed of a core and a shell phase formed on the core, the shell phase containing a resin A, and the core containing a binder resin, a colorant and a wax, wherein (i) in measurement of the resin A by a differential scanning calorimetry (DSC), a peak temperature TpA (° C.) of a maximum endothermic peak in a first temperature rise is at least 55° C. but not more than 80° C.;

(ii) in measurement of a viscoelasticity of the resin A, a loss elastic modulus G"a (TpA-10) at a temperature TpA-10 (° C.) which is 10° C. lower than the TpA is at least $1\times10^7$ Pa but not more than $1\times10^8$ Pa;

(iii) in measurement of the viscoelasticity of the resin A, when the loss elastic modulus at the TpA (° C.) is G"a (TpA) [Pa], the loss elastic modulus at a temperature TpA+10 (° C.) which is 10° C. higher than the TpA is G"a (TpA+10) [Pa], and the loss elastic modulus at a temperature TpA+25 (° C.) which is 25° C. higher than the TpA is G"a (TpA+25) [Pa], and in measurement of a viscoelasticity of the binder resin, when a loss elastic modulus at the TpA+10 (° C.) is G"b(TpA+10) [Pa] and the loss elastic modulus at the TpA+25 (° C.) is G"b(TpA+25) [Pa], G"a(TpA), G"a(TpA+10), G"a(TpA+25), G"b(TpA+10) and G"b(TpA+25) satisfy the conditions of the following formulas (1), (2), (3) and (4):

$$1.0\leq\{\log(G''a(TpA))-\log(G''a(TpA+10)\}\leq4.0 \quad (1);$$

$$0.1\leq\{\log(G''a(TpA+10))-\log(G''a(TpA+25)\}\leq0.9 \quad (2);$$

$$-1.5 \leq \{\log(G''a(TpA+10)) - \log(G''b(TpA+10))\} \leq 1.0 \quad (3); \text{ and}$$

$$G''a(TpA+25) > G''b(TpA+25) \quad (4).$$

2. The toner according to claim 1, wherein the resin A is obtained by copolymerizing a vinyl monomer-a which contains a segment capable of forming a crystalline structure in the molecular structure thereof, and a vinyl monomer-b which is free from a segment capable of forming a crystalline structure in the molecular structure thereof.

3. The toner according to claim 2, wherein the resin A is obtained by copolymerizing at least 20.0 mass % but not more than 50.0 mass % of the vinyl monomer-a and at least 50.0 mass % but not more than 80.0 mass % of the vinyl monomer-b, based on the total amount of polymerizable monomers which form the resin A.

4. The toner according to claim 2, wherein the vinyl monomer-b comprises a vinyl monomer having in a homopolymer thereof a glass transition temperature of at least 105° C., the vinyl monomer having in homopolymer thereof a glass transition temperature of at least 105° C. being comprised in a proportion of at least 1.0 mass % but not more than 15.0 mass % based on the total amount of monomer used in copolymerizing resin A.

5. The toner according to claim 1, wherein the toner particles contain at least 3.0 parts by mass but not more than 15.0 parts by mass of the resin A per 100 parts by mass of the core.

6. The toner according to claim 1, wherein the binder resin contains, as a main component, a block polymer in which the segment capable of forming a crystalline structure and a segment incapable of forming a crystalline structure are bonded.

7. The toner according to claim 6, wherein the content of the segment capable of forming a crystalline structure in the binder resin is 50 mass % or more of the total mass of the binder resin.

8. The toner according to claim 2, wherein the vinyl monomer-a is a vinyl monomer which contains a linear alkyl group in the molecular structure or a vinyl monomer which contains a polyester component in the molecular structure.

9. The toner according to claim 1, wherein the toner particles are formed by the steps of:

(I) preparing a resin composition by dissolving or dispersing the binder resin, the colorant and the wax in an organic solvent-containing medium;

(II) preparing a dispersion by dispersing the resin composition in a dispersion medium containing carbon dioxide in a supercritical or liquid state where resin fine particles containing the resin (A) are dispersed; and (III) removing the organic solvent from the dispersion.

* * * * *